US006012518A

United States Patent [19]

Pringle et al.

[11] Patent Number: 6,012,518

[45] Date of Patent: Jan. 11, 2000

[54] ELECTRO-HYDRAULIC WELL TOOL ACTUATOR

[75] Inventors: Ronald E. Pringle, Houston; Arthur J. Morris, Magnolia, both of Tex.; Vitold P. Serafin, Calgary, Canada

[73] Assignee: Camco International Inc., Houston, Tex.

[21] Appl. No.: 09/092,569

[22] Filed: Jun. 5, 1998

Related U.S. Application Data

[60] Provisional application No. 60/048,792, Jun. 6, 1997.

[51] Int. Cl.[7] ..... E21B 23/03

[52] U.S. Cl. ..... 166/66.4; 166/147; 166/385

[58] Field of Search ..... 166/66.4, 100, 166/147, 169, 186, 332.1, 373, 381

[56] References Cited

U.S. PATENT DOCUMENTS

| | | | |
|---|---|---|---|
| 5,240,077 | 8/1993 | Whitsitt | 166/383 |
| 5,353,877 | 10/1994 | DeCorps et al. | 166/385 |
| 5,392,856 | 2/1995 | Broussard, Jr. et al. | 166/285 |
| 5,398,753 | 3/1995 | Obrejanu et al. | 166/98 |
| 5,577,560 | 11/1996 | Coronado et al. | 166/387 |
| 5,810,088 | 9/1998 | Lamirand et al. | 166/377 |
| 5,947,198 | 9/1999 | McKee et al. | 166/66.4 |

*Primary Examiner*—Frank Tsay
*Attorney, Agent, or Firm*—Tabor, Goldstein & Healey, LLP

[57] ABSTRACT

An electro-hydraulic well tool actuator is provided to control fluid-actuated well tools. The actuator may include a cylindrical housing at least one hydraulic fluid flowpath within the housing, a communication link sealably connected to the housing on one end and a control panel located at the earth's surface on the other, at least one solenoid valve mounted in the housing for directing the flow of hydraulic fluid, and at least one discharge port in the housing for delivering pressurized hydraulic fluid to a hydraulically actuated downhole device. Alternate embodiments include an onboard hydraulic system, and different methods of interfacing with downhole fluid actuated devices.

64 Claims, 24 Drawing Sheets

ELECTRO-HYDRAULIC WELL TOOL ACTUATOR

RELATED APPLICATIONS

This application claims the benefit of U.S. Provisional Application No. 60/048,792, filed Jun. 6, 1997.

BACKGROUND OF THE INVENTION

1. Field of the Invention

The present invention relates to well completion equipment, and more specifically to mechanisms for actuating downhole well tools that require pressurized hydraulic fluid to operate.

2. Description of the Related Art

It is well known that many downhole devices require power to operate, or shift from position to position in accordance with the device's intended purpose. A surface controlled subsurface safety valve (SCSSV) requires hydraulic and/or electrical energy from a source located at the surface. Setting a packer that is sealably attached to a string of production tubing requires either a tubing plug together with application of pressure on the tubing, or a separate and retrievable "setting tool" to actuate and set the packer in the tubing. Sliding sleeves or sliding "side door" devices may also require electrical power, hydraulic pressure or a combination thereof, commonly referred to as "electro-hydraulic" activation. It will become apparent to anyone of normal skill in the art that many downhole devices requiring power for actuation can be adapted to utilize this invention. Such devices may comprise: packers, such as those disclosed in U.S. Pat. Nos. 5,273,109, 5,311,938, 5,433,269, and 5,449,040; perforating equipment, such as disclosed in U.S. Pat. Nos. 5,449,039, 5,513,703, and 5,505,261; locking or unlocking devices, such as those disclosed in U.S. Pat. Nos. 5,353,877 and 5,492,173; valves, such as those disclosed in U.S. Pat. Nos. 5,394,951 and 5,503,229; gravel packs, such as those disclosed in U.S. Pat. Nos. 5,531,273 and 5,597,040; flow control devices or well remediation tools, such as those disclosed in U.S. Pat. Nos. 4,429,747, and 4,434,854; and plugs or expansion joints, of the type well known to those in the art.

Each of these well known devices has a method of actuation, or actuation mechanism that is integral and specific to the tool. Many of these devices are actuated only a few times with the expensive actuating mechanism being left unusable in the well with the tool. In virtually every case, actuating mechanisms have seals which direct energy to moving parts that perform the work desired. After its work is completed, the seal may remain in the well for many years where corrosives and stresses in the material may cause seal failure. Seal failure can cause leaks that may compromise the completion, reduce or prohibit further production from the well until such leak is repaired, and compromise the safety of operations personnel.

There is a need for a device which can provide one or more sources of pressurized hydraulic fluid into the downhole environment, enabling actuation of any number of downhole tools, and in one embodiment, be retrieved by any of several well known methods (e.g. a work string, a coiled tubing string, wireline, electric lines, etc.). The device should be adaptable for various downhole tasks in various downhole tools, and be simple to allow for redress in the field. It should also be adaptable for permanent installation in the completion, thereby allowing multiple functions to be performed on multiple tools located therein, all controlled by an operator at a control panel on the earth's surface.

SUMMARY OF THE INVENTION

The present invention has been contemplated to overcome the foregoing deficiencies and meet the above described needs. The present invention is a device which provides one or more sources of pressurized hydraulic fluid to operate equipment located in a subterranean well. In one preferred embodiment, the device is deployed on coiled tubing and comprises at least one electrical conductor which runs from a control panel at the earth's surface to a multiplexer located therein, allowing a "sync-pulse" or multiple data channels to simultaneously control a plurality of functions in the device. These functions may include operating a downhole hydraulic system, and actuation of one or more solenoid valves to direct pressurized hydraulic fluid to one or more discharge ports.

In another preferred embodiment, the device is deployed by wireline, and also comprises at least one electrical conductor which runs from the control panel at the earth's surface to a multiplexer located therein, allowing "sync-pulse" or multiple data channels to simultaneously control a plurality of functions in the device. These functions may also include operating the downhole self-contained hydraulic system, and actuation of solenoid valves to direct pressurized hydraulic fluid to one or more discharge ports.

In another preferred embodiment, the device is permanently mountable downhole, and also comprises at least one electrical conductor which runs from the control panel at the earth's surface to a multiplexer located therein, allowing "sync-pulse" or multiple data channels to simultaneously control a plurality of functions in the device. These functions may also include operating the downhole self-contained hydraulic system, and actuation of solenoid valves to direct pressurized hydraulic fluid to one or more discharge ports.

In another preferred embodiment, the device is permanently mountable downhole, and also comprises at least one electrical conductor which runs from the control panel at the earth's surface to a multiplexer located therein, allowing "sync-pulse" or multiple data channels to simultaneously control a plurality of functions in the device. Additionally, a hydraulic control line runs from the control panel at the earth's surface to supply pressurized hydraulic fluid to the downhole device. These functions may also include operating and actuation of solenoid valves to direct pressurized hydraulic fluid to one or more discharge ports.

In another preferred embodiment, the device is permanently mountable downhole, and also comprises at least one communication conduit which runs from the control panel at the earth's surface to a multiplexer located therein, allowing "sync-pulse" or multiple data channels to simultaneously control a plurality of functions in the device. Primary power may come from any well known electrically operated device, such as a downhole submersible pump. Additionally, a hydraulic control line may be run from the control panel at the earth's surface, or from a well known downhole hydraulically operated device, such as a subsurface safety valve, to supply pressurized hydraulic fluid to the downhole device. These functions may also include operating and actuation of solenoid valves to direct pressurized hydraulic fluid to one or more discharge ports.

The electro-hydraulic well tool actuator of the present invention includes a cylindrical housing having a first end and a second end; a communication link sealably connecting a control panel at the earth's surface to the first end of the housing; at least one hydraulic fluid flowpath within said housing; a source of pressurized hydraulic fluid to be communicated to the at least one hydraulic fluid flowpath; at least one discharge port in fluid communication with the at least one hydraulic fluid flowpath and exciting the housing for delivering pressurized hydraulic fluid to a fluid-actuated device; and at least one solenoid valve mounted in the housing for directing the pressurized hydraulic fluid from the at least one hydraulic fluid flowpath to the at least one discharge port. Another feature of the present invention is that a multiplexer is mounted within the first end of the housing, wherein the communication link is a single electrical conductor, and the electrical conductor is connected to the multiplexer. Another feature of the present invention is that the multiplexer is connected by at least one secondary electrical conductor to the at least one solenoid valve. Another feature of the present invention is that the communication link is at least one electrical connector being connected to the at least one solenoid valve. Another feature of the present invention is that an electrical battery is mounted within the housing, wherein the communication link is an acoustic conductor that communicates with the battery. Another feature of the present invention is that the source of pressurized hydraulic fluid is a hydraulic system mounted within the housing and connected to the communication link. Another feature of the present invention is that the hydraulic system includes an integral hydraulic pump, motor, and reservoir mounted within the housing, and the hydraulic system is in fluid communication with the at least one hydraulic fluid flowpath. Another feature of the present invention is that the hydraulic system further includes a solenoid valve, connected to the communication link, for directing the flow of pressurized hydraulic fluid from the hydraulic system through the hydraulic fluid flowpath. Another feature of the present invention is that the hydraulic system further includes a capacitor for storing electrical energy. Another feature of the present invention is that the hydraulic system further includes a movable volume compensator piston for displacing a volume of fluid that is utilized at the actuator operates and for compensating for pressure changes caused by temperature fluctuations. Another feature of the present invention is that the source of pressurized hydraulic fluid is located at the earth's surface, and the source is sealably connected to the first end of the housing by a hydraulic control line. Another feature of the present invention is that the source of pressurized hydraulic fluid is another downhole well tool, and the source is sealably connected to the first end of the housing by a hydraulic control line. Another feature of the present invention is that the source of electrical energy is another downhole well tool. Another feature of the present invention is that the downhole well tool is an electric submersible pump. Another feature of the present invention is that the actuator is adapted to be deployed and retrieved by utilization of coiled tubing. Another feature of the present invention is that the actuator is adapted to be deployed and retrieved by utilization of wireline. Another feature of the present invention is that the actuator is adapted to be permanently mounted in a subterranean well.

Another feature of the present invention is that the actuator further includes a first lower flowpath, a second lower flowpath, a third lower flowpath, a fourth lower flowpath, a first discharge port, a second discharge port, a third discharge port, a permanently-set solenoid valve, a set-unset solenoid valve, wherein the at least one hydraulic flowpath is in fluid communication with the first lower flowpath and the second lower flowpath, the first and second lower flowpaths are located adjacent the second end of the cylindrical housing, the first lower flowpath is in fluid communication with a first discharge port, the permanently-set solenoid valve is connected to the communication link and located adjacent the first lower flowpath to control fluid flow therethrough to permanently actuate the fluid-actuate device, the second lower flowpath is in fluid communication with the set-unset solenoid valve, the set-unset solenoid valve is in fluid communication with the first and fourth lower flowpaths and the vent ports, the third lower flowpath is in fluid communication with the second discharge port, and the fourth lower flowpath is in fluid communication with the third discharge port, and the set-unset solenoid valve is connected to the communication link to control fluid flow from the second lower flowpath to the second and third discharge ports. Another feature of the present invention is that the actuator further includes at least one vent port, a first annular seal, a second annular seal, a third annular seal, and a fourth annular seal, wherein the at least one vent port is in fluid communication with the set-unset solenoid valve, the first discharge port exits the second end of the housing between the first and second annular seals, the second discharge port exits the second end of the housing between the second and third annular seals, and the third discharge port exits the second end of the housing between the third and fourth annular seals. Another feature of the present invention is that the set-unset solenoid valve will actuate the fluid-actuated device by simultaneously dispersing pressurized hydraulic fluid through the third discharge port and venting any hydraulic fluid from the fluid-actuated device into the second discharge port through the at least one vent ports, and deactuate the fluid-actuated device by simultaneously dispersing pressurized hydraulic fluid through the second discharge port and venting any hydraulic fluid from the fluid-actuated device into the third discharge port through the at least one vent ports. Another feature of the present invention is that the vented fluid is transferred from the at least one vent ports into a well annulus. Another feature of the present invention is that the set-unset solenoid valve is a shuttle-type solenoid valve. Another feature of the present invention is that the set-unset solenoid valve is a single-acting solenoid valve with a spring return. Another feature of the present invention is that the set-unset solenoid valve is a double-acting solenoid valve with opposing energizable coils.

In another specific embodiment, the actuator of the present invention includes a cylindrical housing having a first end and a second end; a communication link sealably connecting a control panel at the earth's surface to the first end of the housing; at least one hydraulic fluid flowpath within said housing; a hydraulic system mounted within the housing, connected to the communication link, and in fluid communication with the at least one hydraulic fluid flowpath; at least one discharge port in fluid communication with the at least one hydraulic fluid flowpath and exiting the housing for delivering pressurized hydraulic fluid to a fluid-actuated device; at least one solenoid valve mounted in the housing for directing the pressurized hydraulic fluid from the at least one hydraulic fluid flowpath to the at least one discharge port; wherein the actuator is adapted to be retrievably deployed within a subterranean well. Another feature of the present invention is that the actuator further includes a multiplexer mounted within the first end of the housing, wherein the communication link is a single electrical conductor, and the electrical conductor is connected to the multiplexer. Another feature of the present invention is that the multiplexer is connected by at least one secondary electrical connector to the at least one solenoid valve. Another feature of the present invention is that the communication link is at least one electrical connector being connected to the at least one solenoid valve. Another feature of the present invention is that the actuator further includes an electric battery mounted within the housing, wherein the communication link is an acoustic conductor that communicates with the battery. Another feature of the present invention is that the hydraulic system includes an integral hydraulic pump, motor, and reservoir mounted within the housing, the hydraulic system being in fluid communication with the at least one hydraulic fluid flowpath. Another feature of the present invention is that the hydraulic system further includes a solenoid valve, connected to the communication link, for directing the flow of pressurized hydraulic fluid from the hydraulic system through the hydraulic fluid flowpath. Another feature of the present invention is that the hydraulic system further includes a capacitor for storing electrical energy. Another feature of the present invention is that the hydraulic system further includes a movable volume compensator piston for displacing a volume of fluid that is utilized as the actuator operates and for compensating for pressure changes caused by temperature fluctuations. Another feature of the present invention is that the actuator is adapted to be retrievably deployed by utilization of coiled tubing. Another feature of the present invention is that the actuator is adapted to be retrievably deployed by utilization of wireline.

Another feature of the present invention is that the actuator further includes a first lower flowpath, a second lower flowpath, a third lower flowpath, a fourth lower flowpath, a first discharge port, a second discharge port, a third discharge port, a permanently-set solenoid valve, a set-unset solenoid valve, where the at least one hydraulic flowpath is in fluid communication with the first lower flowpath and the second lower flowpath, the first and second lower flowpaths are located adjacent the second end of the cylindrical housing, the first lower flowpath is in fluid communication with a first discharge port, the permanently-set solenoid valve is connected to the communication link and located adjacent the first lower flowpath to control fluid flow therethrough to permanently actuate the fluid-actuate device, the second lower flowpath is in fluid communication with the set-unset solenoid valve, the set-unset solenoid valve is in fluid communication with the third and fourth lower flowpaths and the vent ports, the third lower flowpath is in fluid communication with the second discharge port, and the fourth lower flowpath is in fluid communication with the third discharge port, and the set-unset solenoid valve is connected to the communication link to control fluid flow from the second lower flowpath to the second and third discharge ports. Another feature of the present invention is that the actuator further includes at least one vent port, a first annular seal, a second annular seal, a third annular seal, and a fourth annular seal, wherein the at least one vent port is in fluid communication with the set-unset solenoid valve, the first discharge port exits the second end of the housing between the first and second annular seals, the second discharge port exits the second end of the housing between the second and third annular seals, and the third discharge port exits the second end of the housing between the third and fourth annular seals. Another feature of the present invention is that the set-unset solenoid valve will actuate the fluid-actuated device by simultaneously dispersing pressurized hydraulic fluid through the third discharge port and venting any hydraulic fluid from the fluid-actuated device into the second discharge port through the at least one vent port, and deactuate the fluid-actuated device by simultaneously dispersing pressurized hydraulic fluid through the second discharge port and venting any hydraulic fluid from the fluid-actuated device into the third discharge port through the at least one vent port. Another feature of the present invention is that the vented fluid is transferred from the at least one vent port into a well annulus. Another feature of the present invention is that the set-unset valve is a shuttle-type solenoid valve. Another feature of the present invention is that the set-unset solenoid valve is a single-acting solenoid valve with a spring return. Another feature of the present invention is that the set-unset solenoid valve is a double-acting solenoid valve with opposing energizable coils.

In another specific embodiment, the actuator of the present invention includes a cylindrical housing having a first end and a second end; a communication link sealably connecting a control panel at the earth's surface to the first end of the housing; at least one hydraulic fluid flowpath within said housing; a hydraulic system mounted within the housing, connected to the communication link, and in fluid communication with the at least one hydraulic fluid flowpath; at least one discharge port in fluid communication with the at least one hydraulic fluid flowpath and exiting the housing for delivering pressurized hydraulic fluid to a fluid-actuated device; at least one solenoid valve mounted in the housing for directing the pressurized hydraulic fluid from the at least one hydraulic fluid flowpath to the at least one discharge port; wherein the actuator is adapted to be permanently mounted within a subterranean well. Another feature of the present invention is that the actuator further includes a multiplexer mounted within the first end of the housing, wherein the communication link is a single electrical conductor, the electrical conductor being connected to the multiplexer. Another feature of the present invention is that the multiplexer is connected by at least one secondary electrical connector to the at least one solenoid valve. Another feature of the present invention is that the communication link is at least one electrical connector being connected to the at least one solenoid valve. Another feature of the present invention is that the actuator further includes an electric battery mounted within the housing, wherein the communication link is an acoustic conductor that communicates with the battery. Another feature of the present invention is that the hydraulic system includes an integral hydraulic pump, motor, and reservoir mounted within the housing, the hydraulic system being in fluid communication with the at least one hydraulic fluid flowpath. Another feature of the present invention is that the hydraulic system further includes a solenoid valve, connected to the communication link, for directing the flow of pressurized hydraulic fluid from the hydraulic system through the hydraulic fluid flowpath. Another feature of the present invention is that the hydraulic system further includes a capacitor for storing electrical energy. Another feature of the present invention is that the hydraulic system further includes a movable volume compensator piston for displacing a volume of fluid that is utilized as the actuator operates and for compensating for pressure changes caused by temperature fluctuations.

Another feature of the present invention is that the actuator further includes a first lower flowpath, a second lower flowpath, a third lower flowpath, a fourth lower flowpath, a first discharge port, a second discharge port, a third discharge port, a permanently-set solenoid valve, a set-unset solenoid valve, wherein the at least one hydraulic flowpath is in fluid communication with the first lower flowpath and the second lower flowpath, the first and second lower flowpaths are located adjacent the second end of the cylindrical housing, the first lower flowpath is in fluid communication with a first discharge port, the permanently-set solenoid valve is connected to the communication link and located adjacent the first lower flowpath to control fluid flow therethrough to permanently actuate the fluid-actuate device, the second lower flowpath is in fluid communication with the set-unset solenoid valve, the set-unset solenoid valve is in fluid communication with the third and fourth lower flowpaths and the vent ports, the third lower flowpath is in fluid communication with the second discharge port, the fourth lower flowpath is in fluid communication with the third discharge port, and the set-unset solenoid valve is connected to the communication link to control fluid flow from the second lower flowpath to the second and third discharge ports. Another feature of the present invention is that the actuator further includes at least one vent port being in fluid communication with the set-unset solenoid valve. Another feature of the present invention is that the actuator further includes a first fluid transfer conduit, a second fluid transfer conduit, and a third fluid transfer conduit, the first conduit being connected to the first discharge port, the second conduit being connected to the second discharge port, and the third conduit being connected to the third discharge port, whereby pressurized fluid may be transferred to and from the fluid-actuated device. Another feature of the present invention is that the set-unset solenoid valve will actuate the fluid-actuated device by simultaneously dispersing pressurized hydraulic fluid through the third discharge port and third conduit and venting any hydraulic fluid from the fluid-actuated device into the second discharge port through the second conduit and to the at least one vent port, and deactuate the fluid-discharge port and second conduit and venting any hydraulic fluid from the fluid-actuated device into the third discharge port through the third conduit and to the at least one vent port. Another feature of the present invention is that the vented fluid is transferred from the at least one vent port into a well annulus. Another feature of the present invention is that the vented fluid is transferred from the at least one vent port to the hydraulic system to be reused. Another feature of the present invention is that the actuator further includes an auxiliary port in fluid communication with the at least one hydraulic flowpath to operate an additional well tool. Another feature of the present invention is that the set-unset solenoid valve is a shuttle-type solenoid valve. Another feature of the present invention is that the set-unset solenoid valve is a single-acting solenoid valve with a spring return. Another feature of the present invention is that the set-unset solenoid valve is a double-acting solenoid valve with opposing energizable coils. Another feature of the present invention is that the source of electrical energy is another downhole well tool. Another feature of the present invention is that the downhole well tool is an electric submersible pump.

In another specific embodiment, the actuator of the present invention includes a cylindrical housing having a first end and a second end; a communication link sealably connecting a control panel at the earth's surface to the first end of the housing; at least one hydraulic fluid flowpath within said housing; an external source of pressurized hydraulic fluid sealably connected to the first end of the cylindrical housing and in fluid communication with the at least one hydraulic fluid flowpath; at least one discharge port in fluid communication with the at least one hydraulic fluid flowpath and exiting the housing for delivering pressurized hydraulic fluid to a fluid-actuated device; at least one solenoid valve mounted in the housing for directing the pressurized hydraulic fluid from the at least one hydraulic fluid flowpath to the at least one discharge port; wherein the actuator is adapted to be permanently mounted within a subterranean well. Another feature of the present invention is that the actuator further includes a multiplexer mounted within the first end of the housing, wherein the communication link is a single electrical conductor, the electrical conductor being connected to the multiplexer. Another feature of the present invention is that the multiplexer is connected by at least one secondary electrical connector to the at least one solenoid valve. Another feature of the present invention is that the communication link is at least one electrical connector being connected to the at least one solenoid valve. Another feature of the present invention is that the actuator further includes an electric battery mounted within the housing, wherein the communication link is an acoustic conductor that communicates with the battery.

Another feature of the present invention is that the actuator further includes a first lower flowpath, a second lower flowpath, a third lower flowpath, a fourth lower flowpath, a first discharge port, a second discharge port, a third discharge port, a permanently-set solenoid valve, a set-unset solenoid valve, wherein the at least one hydraulic flowpath is in fluid communication with the first lower flowpath and the second lower flowpath, the first and second lower flowpaths are located adjacent the second end of the cylindrical housing, the first lower flowpath is in fluid communication with a first discharge port, the permanently-set solenoid valve is connected to the communication link and located adjacent the first lower flowpath to control fluid flow therethrough to permanently actuate the fluid-actuate device, the second lower flowpath is in fluid communication with the set-unset solenoid valve, the set-unset solenoid valve is in fluid communication with the third and fourth lower flowpaths and the vent ports, the first lower flowpath is in fluid communication with the second discharge port, and the fourth lower flowpath is in fluid communication with the third discharge port, and the set-unset solenoid valve is connected to the communication link to control fluid flow from the second lower flowpath to the second and third discharge ports. Another feature of the present invention is that the actuator further includes at least one vent port being in fluid communication with the set-unset solenoid valve.

Another feature of the present invention is that the actuator further includes a first fluid transfer conduit, a second fluid transfer conduit, and a third fluid transfer conduit, the first conduit being connected to the first discharge port, the second conduit being connected to the second discharge port, and the third conduit being connected to the third discharge port, whereby pressurized fluid may be transferred to and from the fluid-actuated device. Another feature of the present invention is that the set-unset solenoid valve will actuate the fluid-actuated device by simultaneously dispersing pressurized hydraulic fluid through the third discharge port and third conduit and venting any hydraulic fluid from the fluid-actuated device into the second discharge port through the second conduit and to the at least one vent port, and deactuate the fluid-actuated device by simultaneously dispersing pressurized hydraulic fluid through the second discharge port and second conduit and venting any hydraulic fluid from the fluid-actuated device into the third discharge port through the third conduit and to the at least one vent port. Another feature of the present invention is that the vented fluid is transferred from the at least one vent port into a well annulus. Another feature of the present invention is that the set-unset solenoid valve is a shuttle-type solenoid valve the set-unset solenoid valve is a single-acting solenoid valve with a spring return. Another feature of the present invention is that the set-unset solenoid valve is a double-acting solenoid valve with opposing energizable coils.

Another feature of the present invention is that the source of electrical energy is another downhole well tool. Another feature of the present invention is that the downhole well tool is an electric submersible pump.

BRIEF DESCRIPTION OF THE DRAWINGS

FIGS. 1A through 1J illustrate a longitudinal view shown in section and elevation of a coiled-tubing-deployed electro-hydraulic well tool actuator of the present invention, having a self contained hydraulic system and three hydraulic fluid discharge ports.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

While the present invention is a mechanism supplying and controlling pressurized hydraulic fluid in a downhole environment, and will be described in conjunction with its use in operating and controlling a well packer, for purposes of illustration only, it is to be understood that the described mechanisms can be used in other well tools where operation using pressurized hydraulic fluid is a desired end. It will be readily apparent to one skilled in the art of hydraulically operated downhole tools, of the many possible uses of the present invention. Uses of the present invention include, but is not limited to, uses with these device: packers, perforating equipment, locking or unlocking devices, valves, plugs, expansion joints, gravel packs, flow control devices, or well remediation tools.

Coiled-Tubing/Wireline-Deployed Embodiment

Figure 1A:
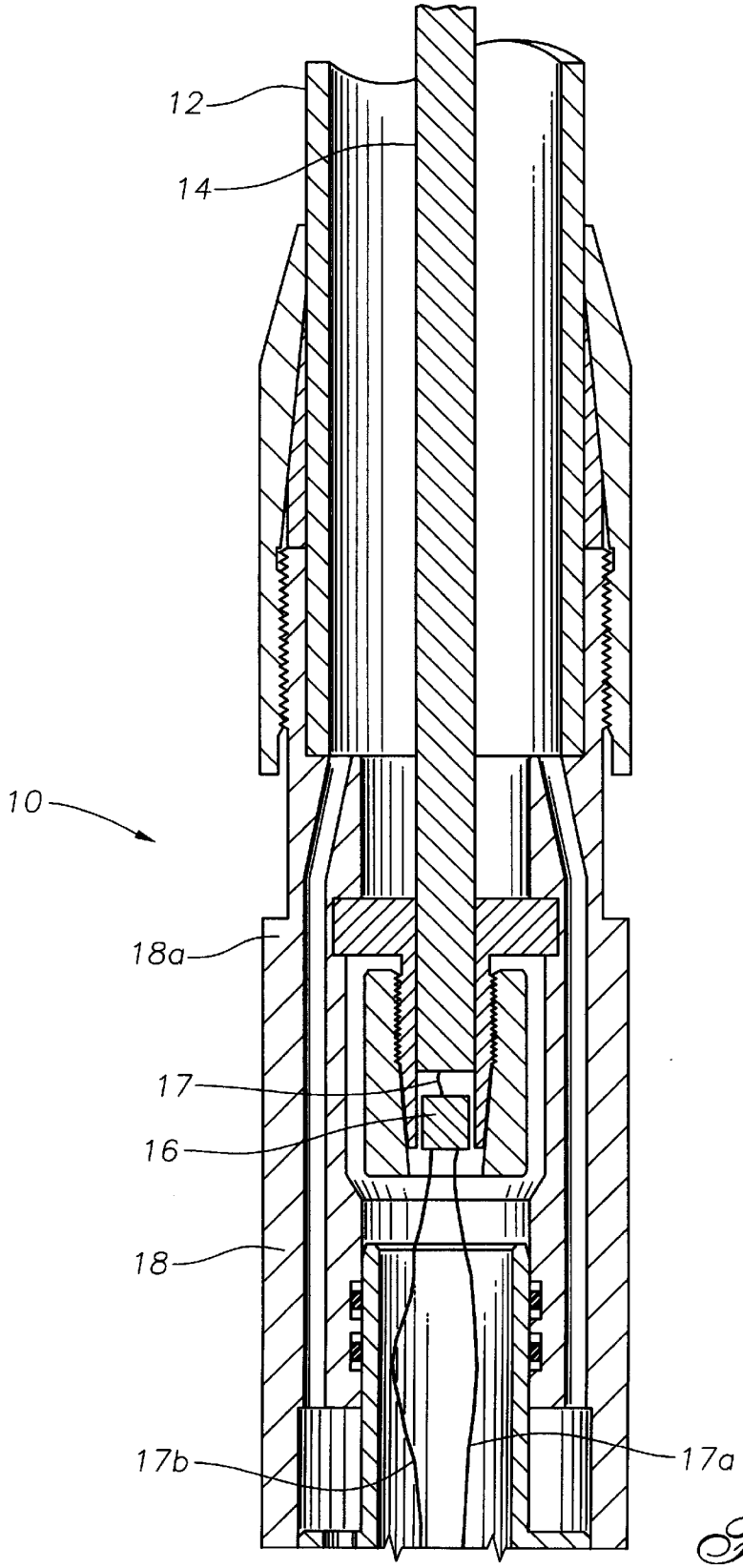
Figure 1B:
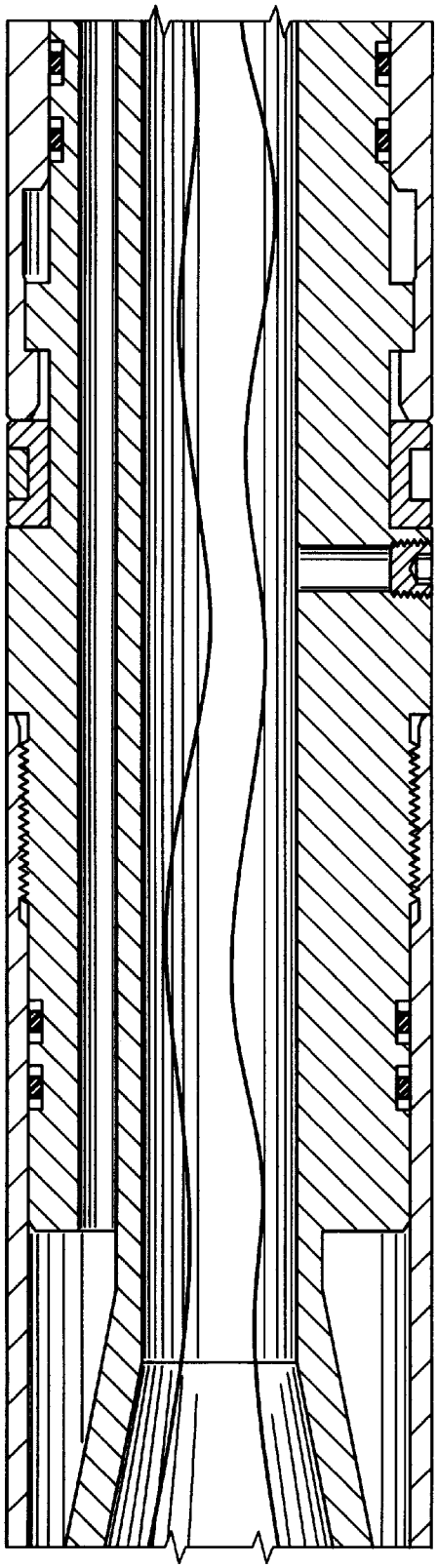
Figure 1C:
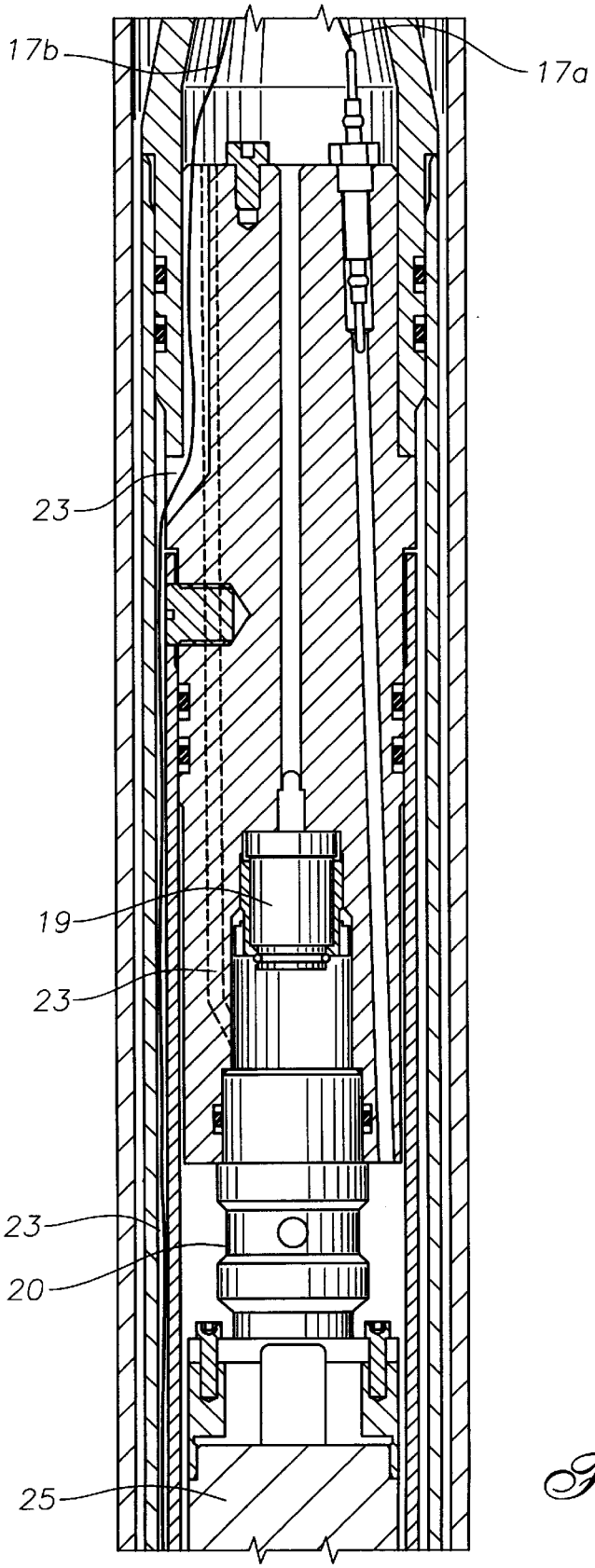
Figure 1D:
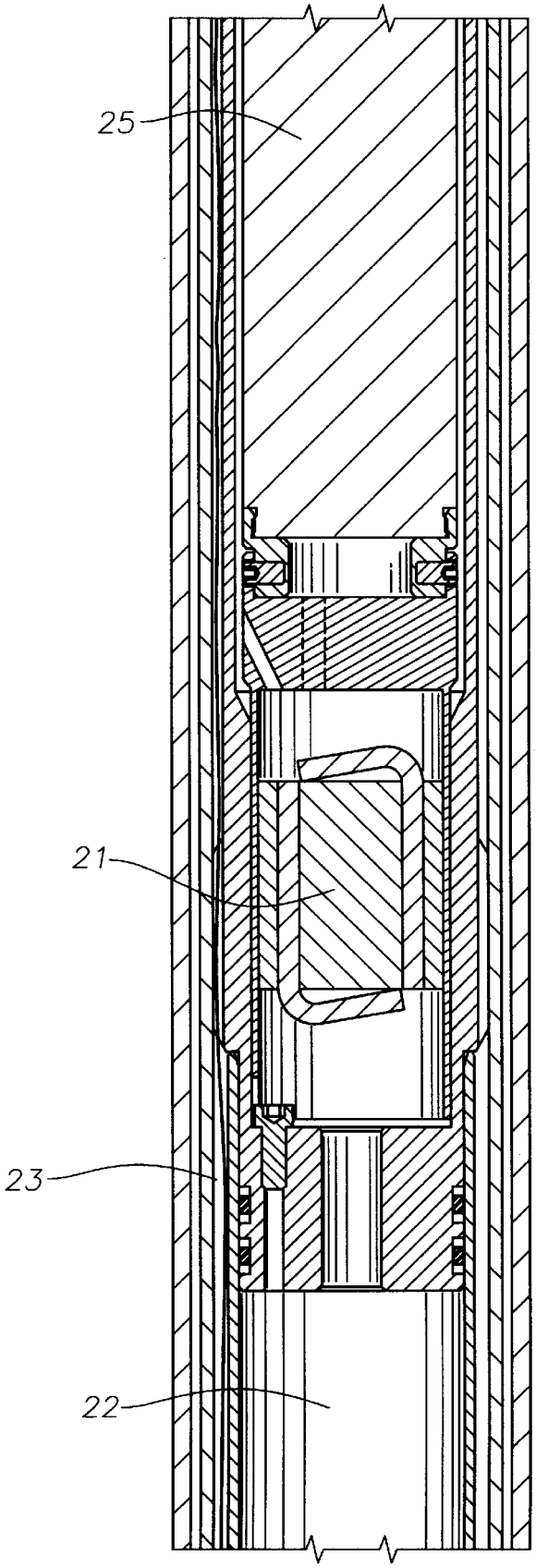
Figure 1E:
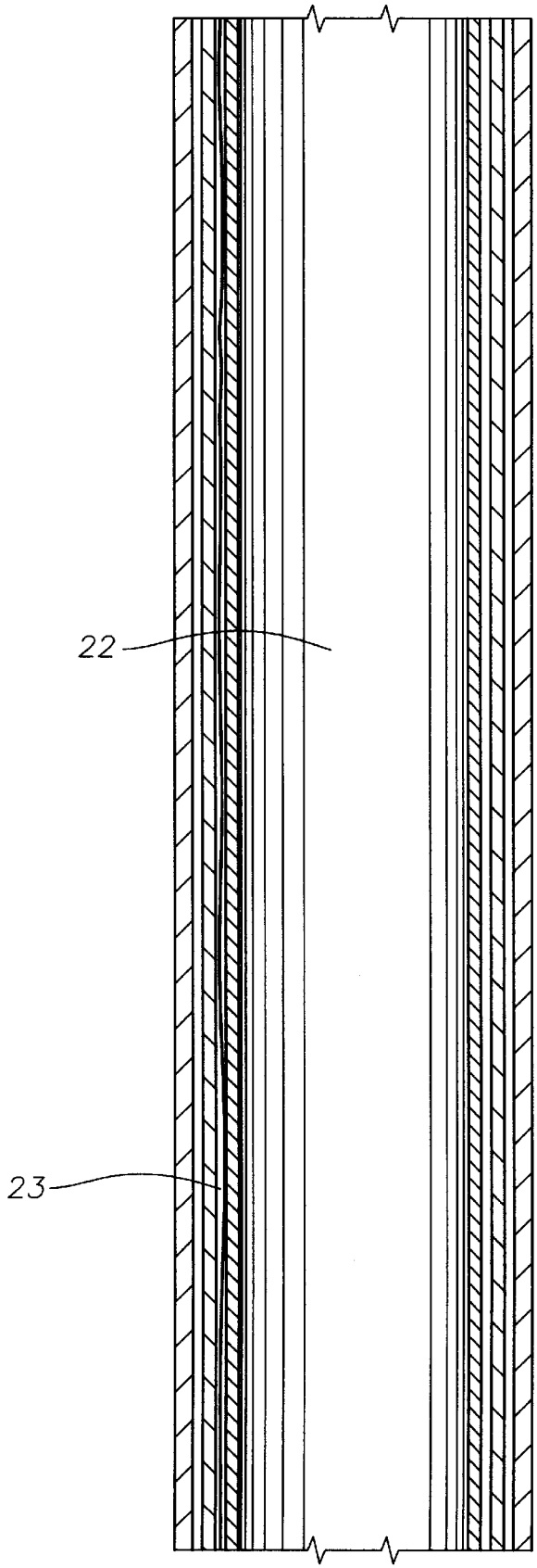
Figure 1F:
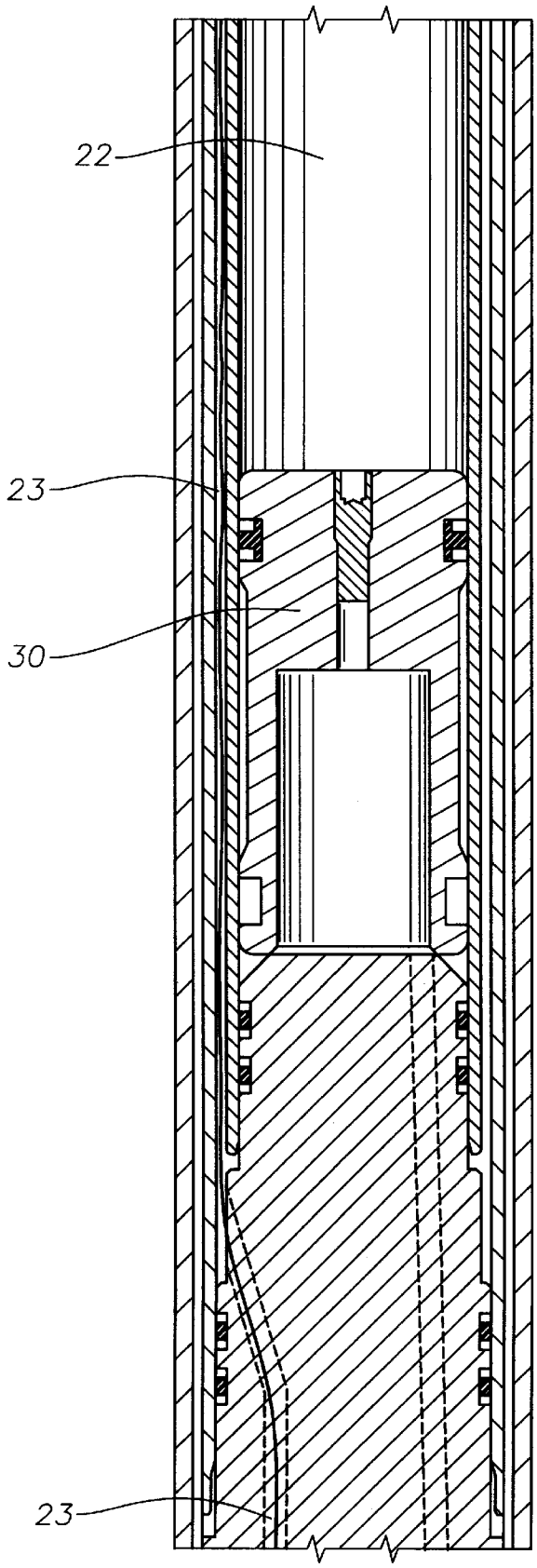
Figure 1G:
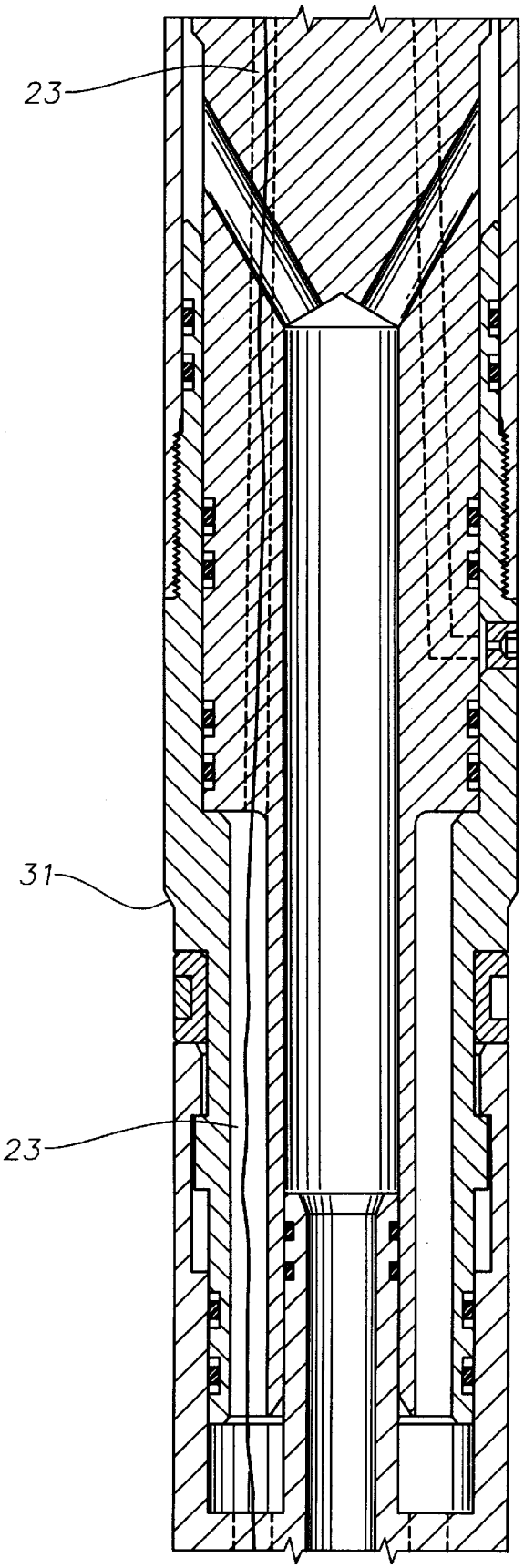
Figure 1H:
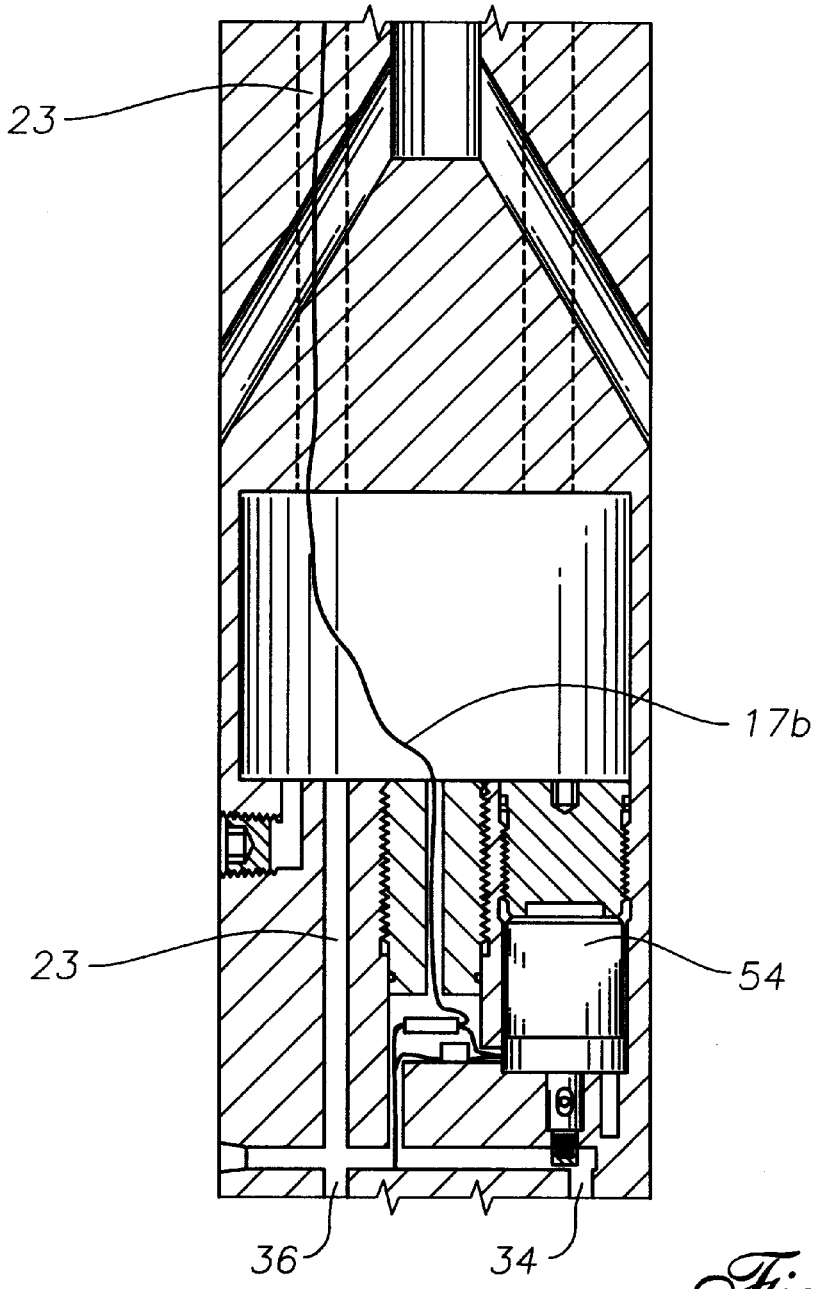
Figure 1J:
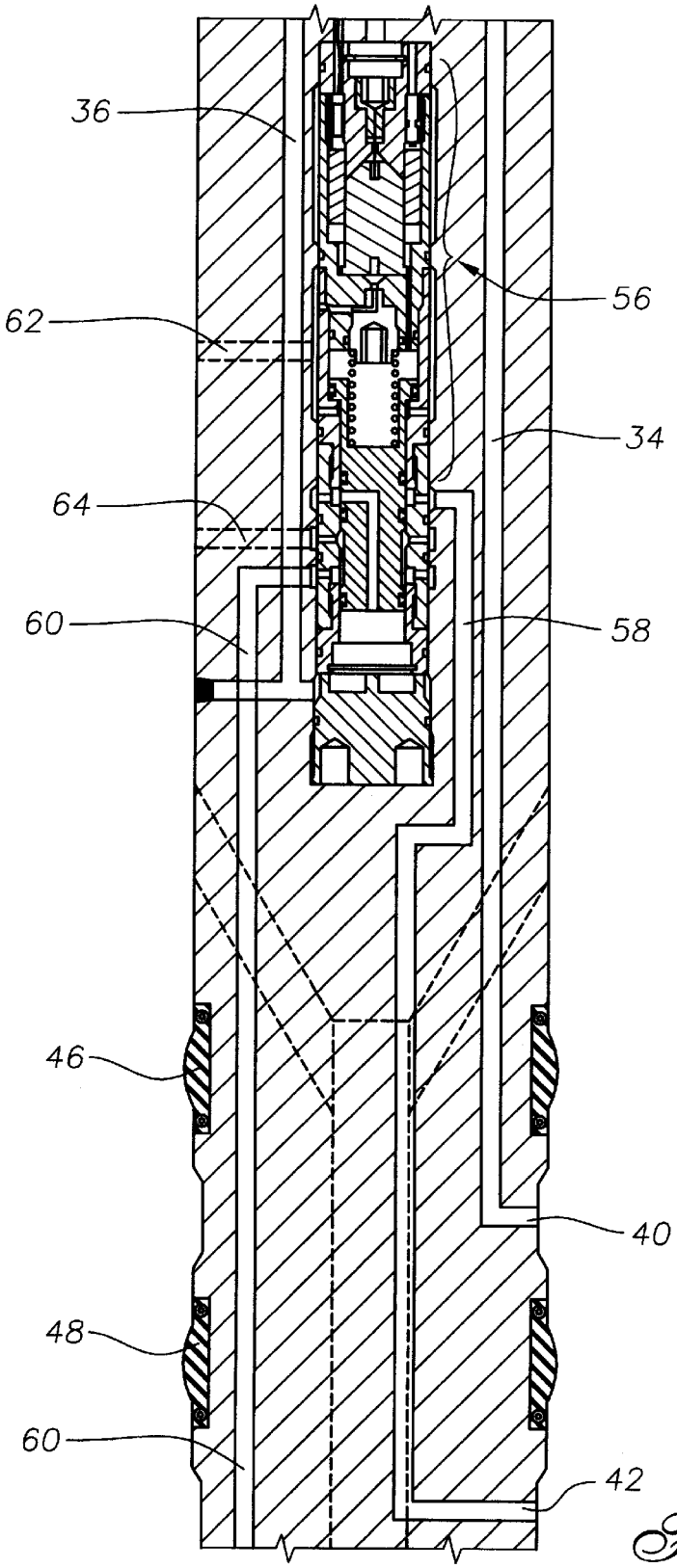
Figure 1J:
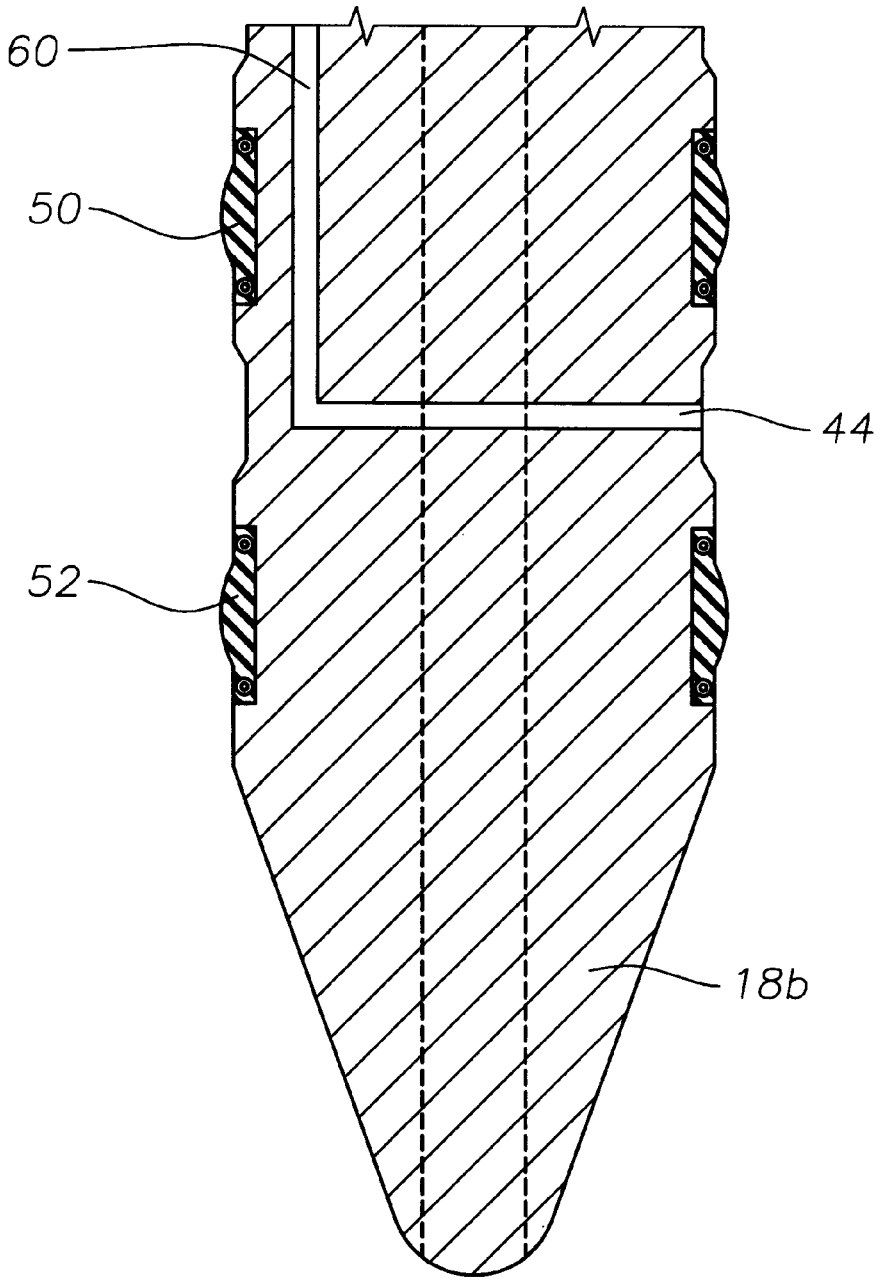

Referring to the drawing in detail, wherein like numerals denote identical elements throughout the several views, there is shown in FIGS. 1A through 1J a specific embodiment of an electro-hydraulic well tool actuator 10 constructed in accordance with the present invention. As shown in FIG. 1A, this embodiment of the present invention is lowered into a well (not shown) on coiled tubing 12 or a wireline (not shown) to actuate a packer (not shown). The actuator 10 includes a cylindrical housing 18 having a first end 18*a* (FIG. 1A) and a second end 18*b* (FIG. 1J). A communication link 14 is sealably connected between a control panel at the earth's surface (not shown) and the first end 18*a* of the cylindrical housing 18. In a specific embodiment, the communication link 14 may be one or more electrical conductors. The number of electrical conductors running to the earth's surface will depend on whether a multiplexer 16 is provided. If the actuator 10 is provided with the multiplexer 16, the communication link 14 may be a single electrical conductor 17 connected from the earth's surface to the multiplexer 16. Further, in this scenario, secondary electrical conductors 17*a* and 17*b* are connected from the multiplexer 16 to each device—described below—on the actuator 10 to be controlled from the earth's surface. If no multiplexer 16 is provided, then the communication link 14 includes separate electrical conductors 17*a* and 17*b* for establishing an electrical connection between the earth's surface and each device—described below—on the actuator 10 to be controlled from the earth's surface. In another specific embodiment, the communication link 14 may be an acoustic conductor (not shown), of the type well known in the art, connected to a battery (not shown) mounted within the housing 18.

Electrical power flows through the electrical conductor 17 and into the multiplexer 16. Referring to FIG. 1C, electric power is then directed through the electrical conductor 17*a* to energize a solenoid 19 that operates a downhole hydraulic pump 20. The pump 20, which is driven by a motor 25, draws pressurized hydraulic fluid from a reservoir 22, shown in FIGS. 1D–1F, located inside the housing 18 of the actuator 10. As shown in FIG. 1F, an axially movable volume compensator piston 30 is provided to displace the volume of fluid that is utilized as the actuator 10 of the present invention operates and to compensate for pressure changes caused by temperature fluctuations. As shown in FIG. 1D, a capacitor 21 may be provided as part of the hydraulic system to store electrical energy for later use, in a manner known to those of skill in the art. The pressurized hydraulic fluid is pumped from the reservoir 22 through a hydraulic fluid flowpath 23 (see FIGS. 1C through 1H) to the second end 18*b* of the housing 18. With reference to FIGS. 1H and 1I, the hydraulic fluid flowpath 23 is in fluid communication with a first lower flowpath 34 and a second lower flowpath 36. The first lower flowpath 34 is in fluid communication with a first discharge port 40 that exits the second end 18*b* of the housing 18 at a point between a first annular seal 46 and a second annular seal 48. A permanently-set solenoid valve 54 (FIG. 1H) is electrically connected by the electrical conductor 17*b* to the communication link 14 and mounted within the housing 18 to control fluid flow through the first lower flowpath 34. When it is desired to permanently set the packer (not shown), the solenoid valve 54 is energized via the communication link 14 thereby opening the first lower flowpath 34 and discharging pressurized hydraulic fluid through the first discharge port 40.

The second lower flowpath 36 is in fluid communication with a set-unset solenoid valve 56. The set-unset solenoid valve 56 is in fluid communication with a third lower flowpath 58, a fourth lower flowpath 60, a first vent port 62 and a second vent port 64. The third lower flowpath 58 is in fluid communication with a second discharge port 42 that exits the second end 18*b* of the housing 18 at a point between the second annular seal 48 and a third annular seal 50. The fourth lower flowpath 60 is in fluid communication with a third discharge port 44 (FIG. 1J) that exits the second end 18*b* of the housing 18 at a point between the third annular seal 50 and a fourth annular seal 52. The set-unset solenoid valve 56 controls the flow of pressurized hydraulic fluid from the second lower flowpath 36 to the second discharge port 42 and to the third discharge port 44. The second end 18*b* of the housing 18 is adapted to be mounted to a fluid-actuated well tool (not shown), such as a packer, so that the first, second, and third discharge ports 40, 42, and 44 are aligned with corresponding passageways in the fluid-actuated well tool (not shown), such as the passageways 84, 92, and 94 in the novel packer 82 illustrated in FIG. 4, which will be more fully described below.

The set-unset solenoid valve 56 may be of the type illustrated in FIGS. 6A and 6B of U.S. Pat. No. 5,314,032 (Pringle et al.), which is commonly assigned hereto and incorporated herein by reference. The valve 56 may be: a shuttle-type solenoid valve; a single-acting solenoid valve with a spring return; or a double-acting solenoid valve with opposing energizable coils. The design and operation of these types of valves are well known to those of skill in the art. In a preferred embodiment, when it is desired to set the fluid-actuated tool, such as a packer (FIG. 4) the set-unset valve 56 will simultaneously disperse pressurized hydraulic fluid through the third discharge port 44 and vent any hydraulic fluid from the packer into the second discharge port 42 through one of the vent ports 62 or 64 and into the annulus (not shown). Likewise, when it is desired to unset the packer, the set-unset valve 56 will simultaneously disperse pressurized hydraulic fluid through the second discharge port 42 and vent hydraulic fluid from the packer into the third discharge port 44 through one of the vent ports 62 or 63 and into the annulus (not shown).

While the present embodiment has been illustrated and described with three discharge ports 40, 42, and 44, it should be understood that more or fewer discharge ports may be employed and still be within the spirit and scope of the present invention.

Permanently Mounted Embodiments

Two specific permanently-mounted embodiments of the well tool actuator of the present invention are contemplated: (1) one with its own on-board hydraulic fluid system, such as the pump 20 and reservoir 22 system described above; and (2) one without its own hydraulic fluid system that therefore is provided with pressurized hydraulic fluid from an external source.

With Own On-Board Hydraulic System

Referring now to FIGS. 2A through 2I, a permanently mounted embodiment 10' of the present invention is presented. While this configuration may be permanently mounted in any number of positions in the wellbore to operate the intended device, this illustration is for an embodiment mounted in a packer, threadably and sealable fixed thereupon.

While the structure and operation of the well tool actuator 10' is very similar to that of the wireline- or coiled-tubing-deployed actuator 10 discussed above, there are a few differences. One difference is that the actuator 10' is permanently attached to the fluid-actuated device, such as a packer, within the tubing string, whereas the actuator 10, discussed above, is retrievably mounted on coiled tubing or wireline. Another difference is that, with the actuator 10', the first, second, and third discharge ports 40', 42', and 44' exit from the bottom of the housing 18' (see FIG. 2I) instead of from the side of the housing 18, as with the actuator 10 (see FIGS. 1I and 1J). Further, the discharge ports 40', 42', and 44' are provided with fittings 66, 68, and 70 for connecting to conduits 72, 74, and 76 through which pressurized fluid is transferred to the packer (see FIG. 5). Another difference is that, with the actuator 10', instead of venting fluid to the annulus through the vent ports 62' and 64', the fluid should be piped via a conduit (not shown) back to the reservoir 22' between the pump 20' and the volume compensating piston 30' so that the fluid may be reused. This feature is unnecessary with the wireline- or coiled-tubing-deployed actuator 10 because it may be easily retrievable to the surface where the reservoir may be replenished. In addition, the actuator 10' may receive electrical power from any of a number of well known downhole electrically operated devices, such as an electric submersible pump (not shown). Further, the actuator 10' may be provided with an auxiliary port 78 to carry hydraulic fluid to operate a casing vent valve (not shown) or other well tool (not shown).

Figure 2A:
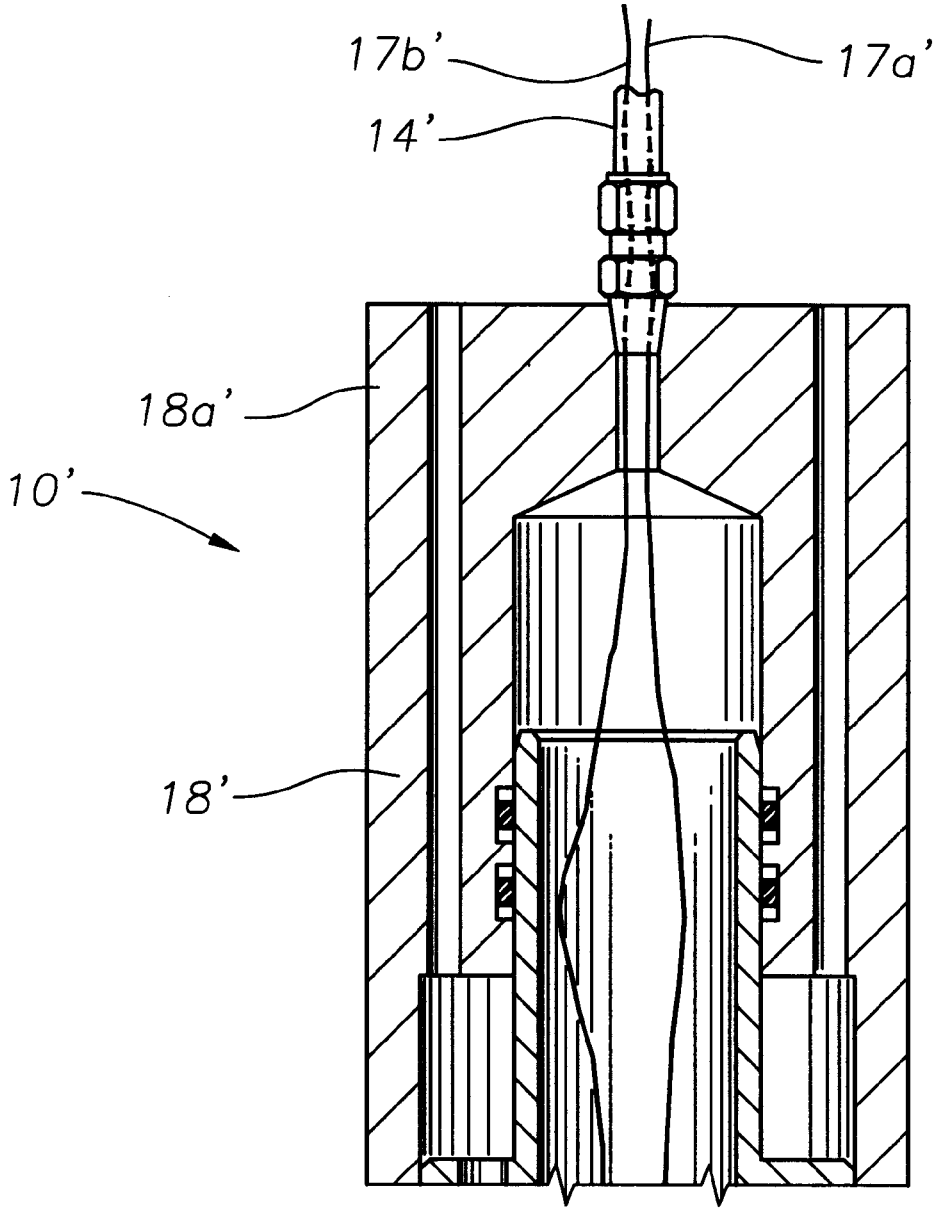
FIGS. 2A through 2I illustrate a longitudinal view shown in section and elevation of a permanently-downhole-mountable electro-hydraulic well tool actuator of the present invention, having a self contained hydraulic system and three hydraulic fluid discharge ports.

More particularly, the actuator 10' includes a cylindrical housing 18' having a first end 18*a'* (FIG. 2A) and a second end 18*b'* (FIG. 2I). A communication link 14' is sealably connected between a control panel at the earth's surface (not shown) and the first end 18*a'* of the cylindrical housing 18'. In a specific embodiment, the communication link 14' may be one or more electrical conductors. As explained above, the number of electrical conductors running to the earth's surface will depend on whether a multiplexer (not shown here) is provided. While it is within the spirit and scope of this invention to provide a multiplexer in this embodiment, no multiplexer is shown here. As such, the communication link 14' is shown to include separate electrical conductors 17*a'* and 17*b'* for establishing an electrical connection between the earth's surface and each device—described below—on the actuator 10' to be controlled from the earth's surface. In another specific embodiment, the communication link 14' may be an acoustic conductor (not shown), of the type well known in the art, connected to a battery (not shown) mounted within the housing 18'.

Figure 2B:
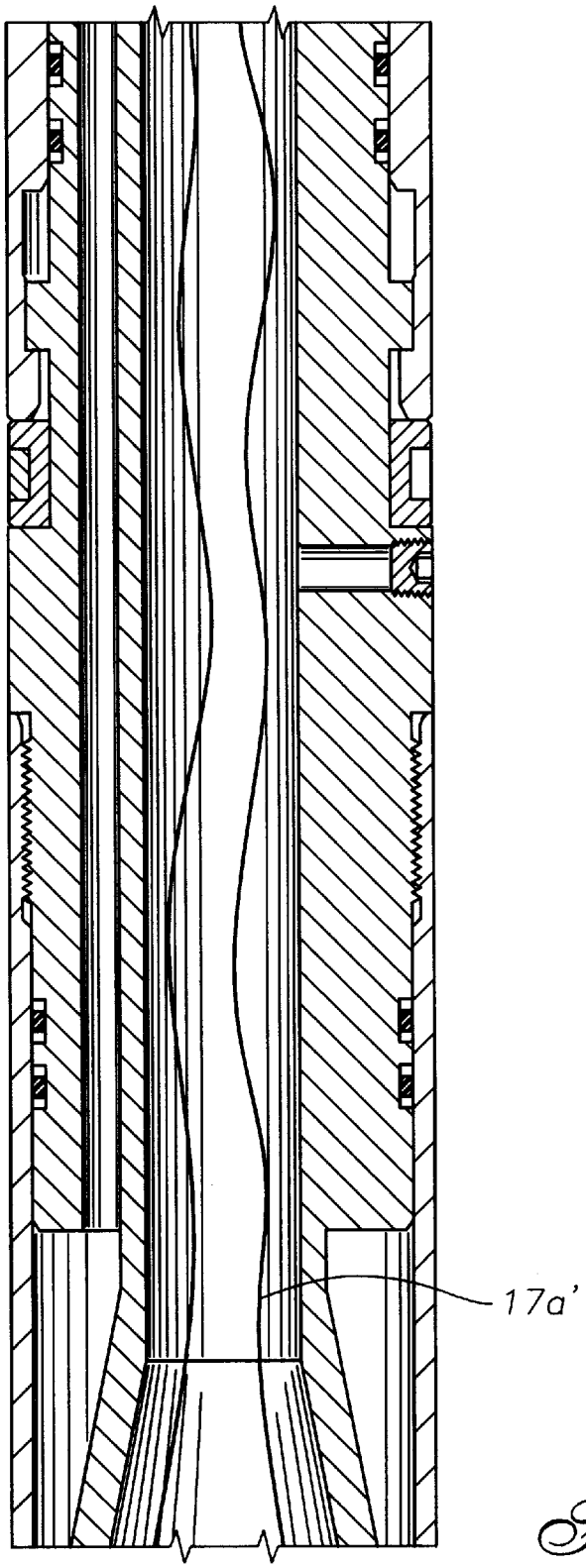
Figure 2C:
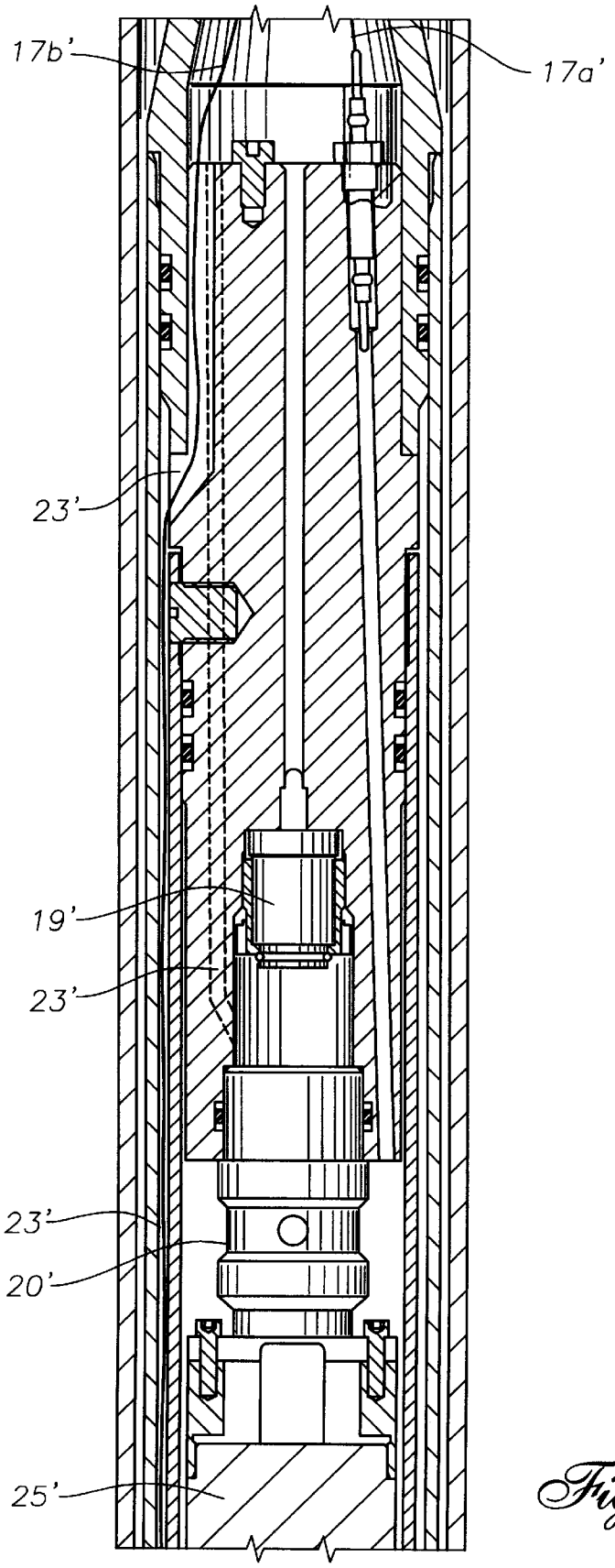
Figure 2D:
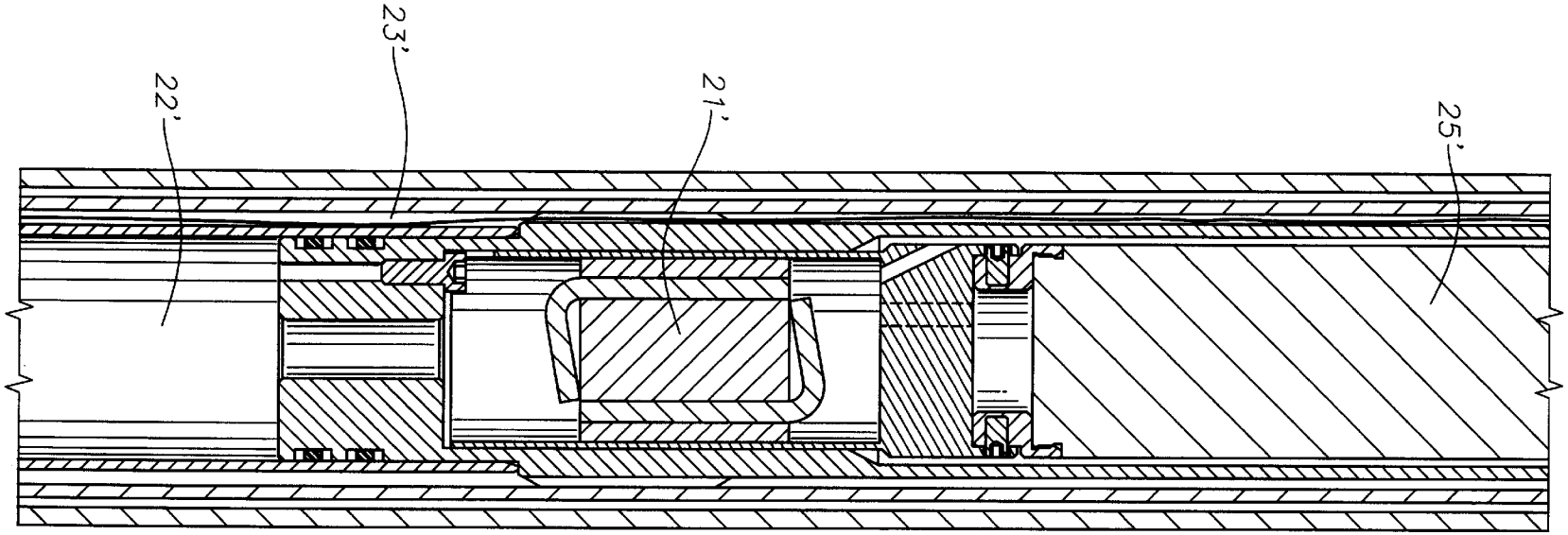
Figure 2E:
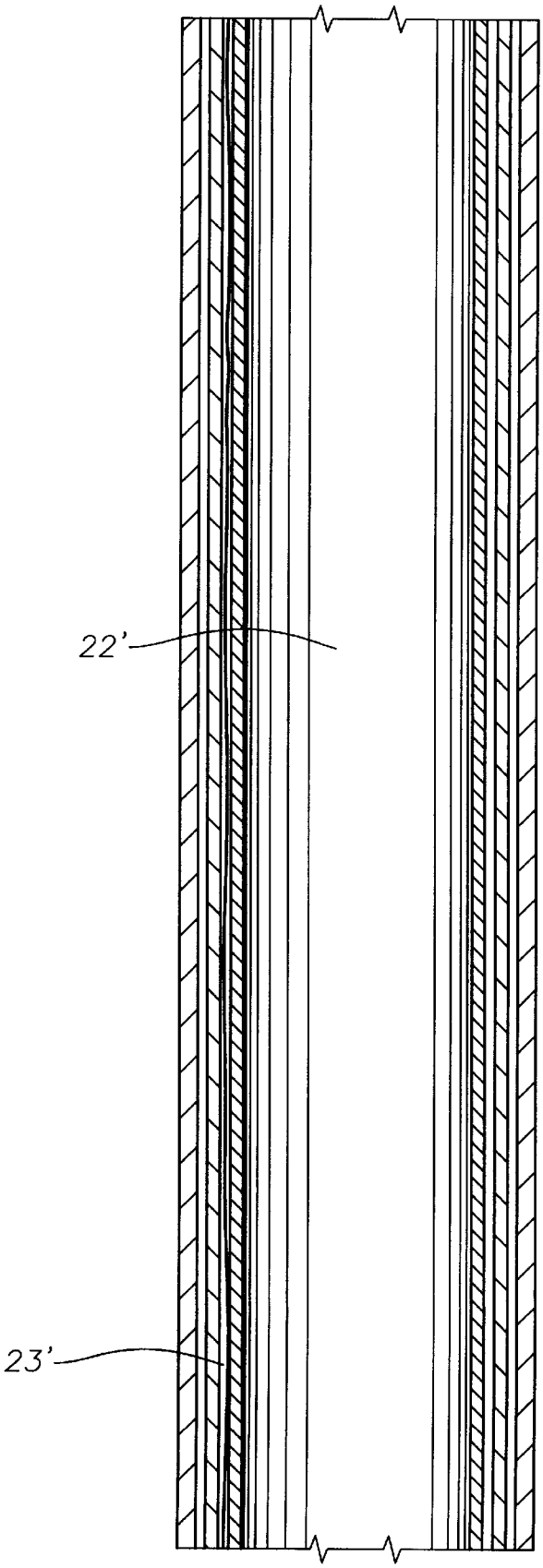
Figure 2F:
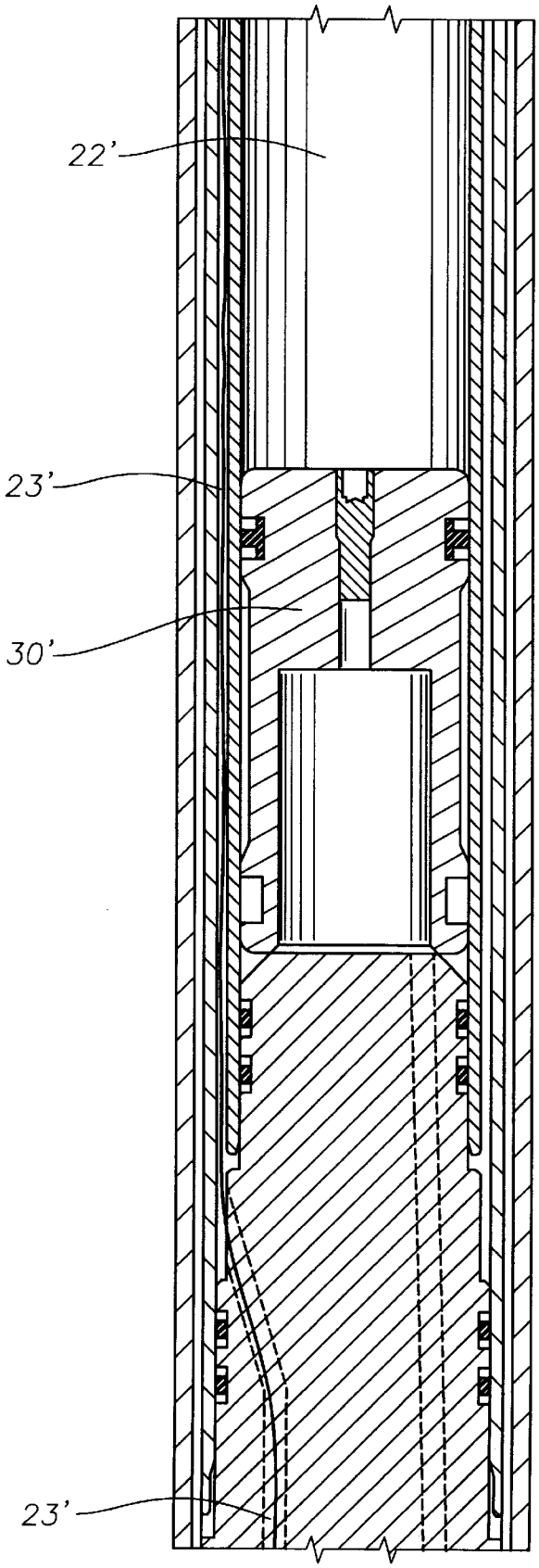
Figure 2G:
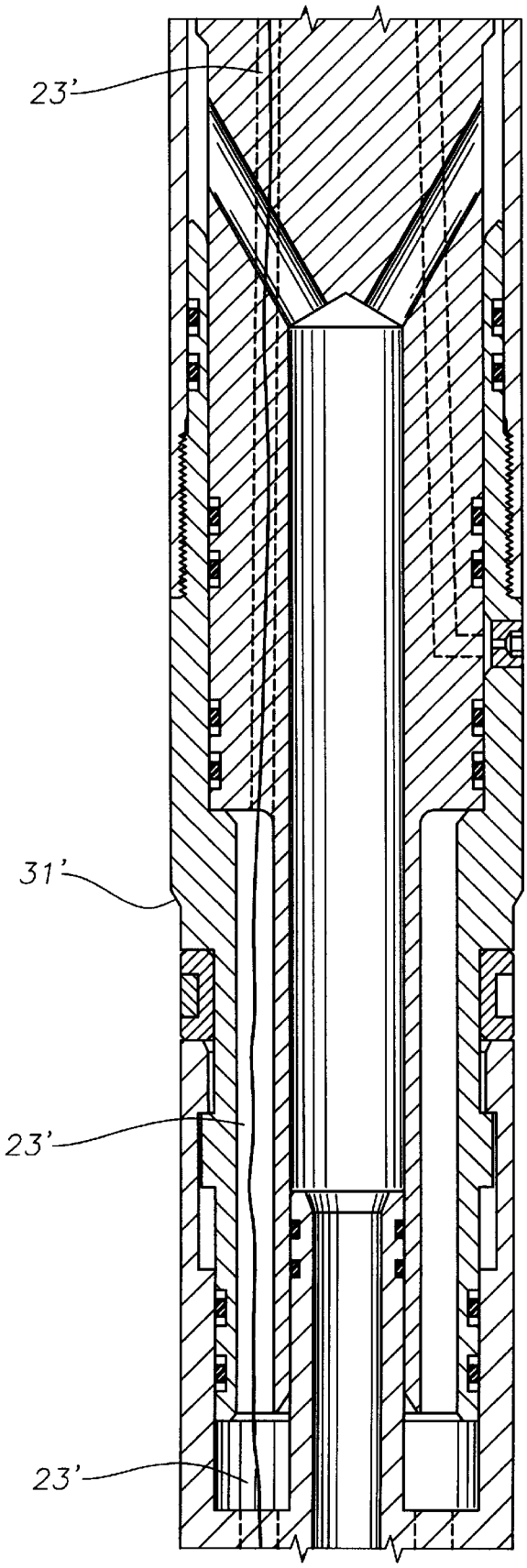
Figure 2H:
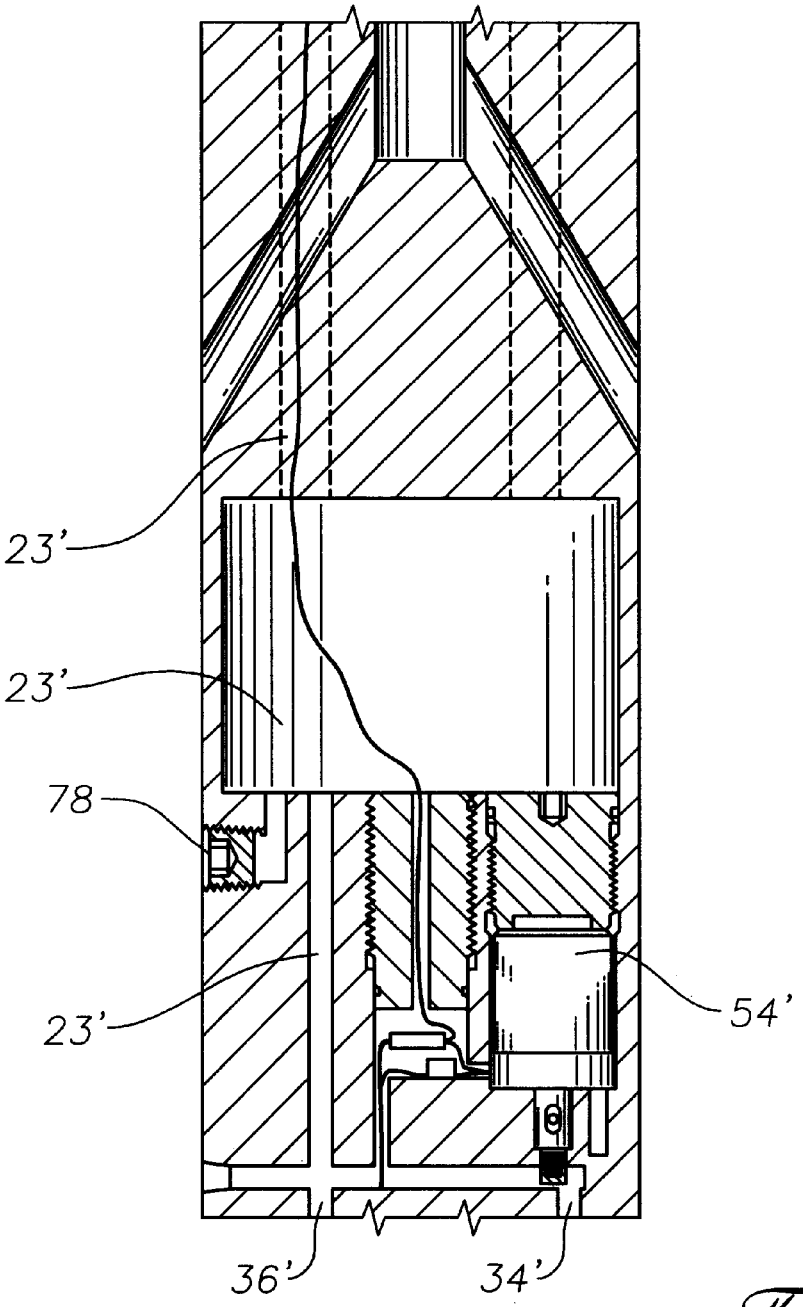
Figure 2J:
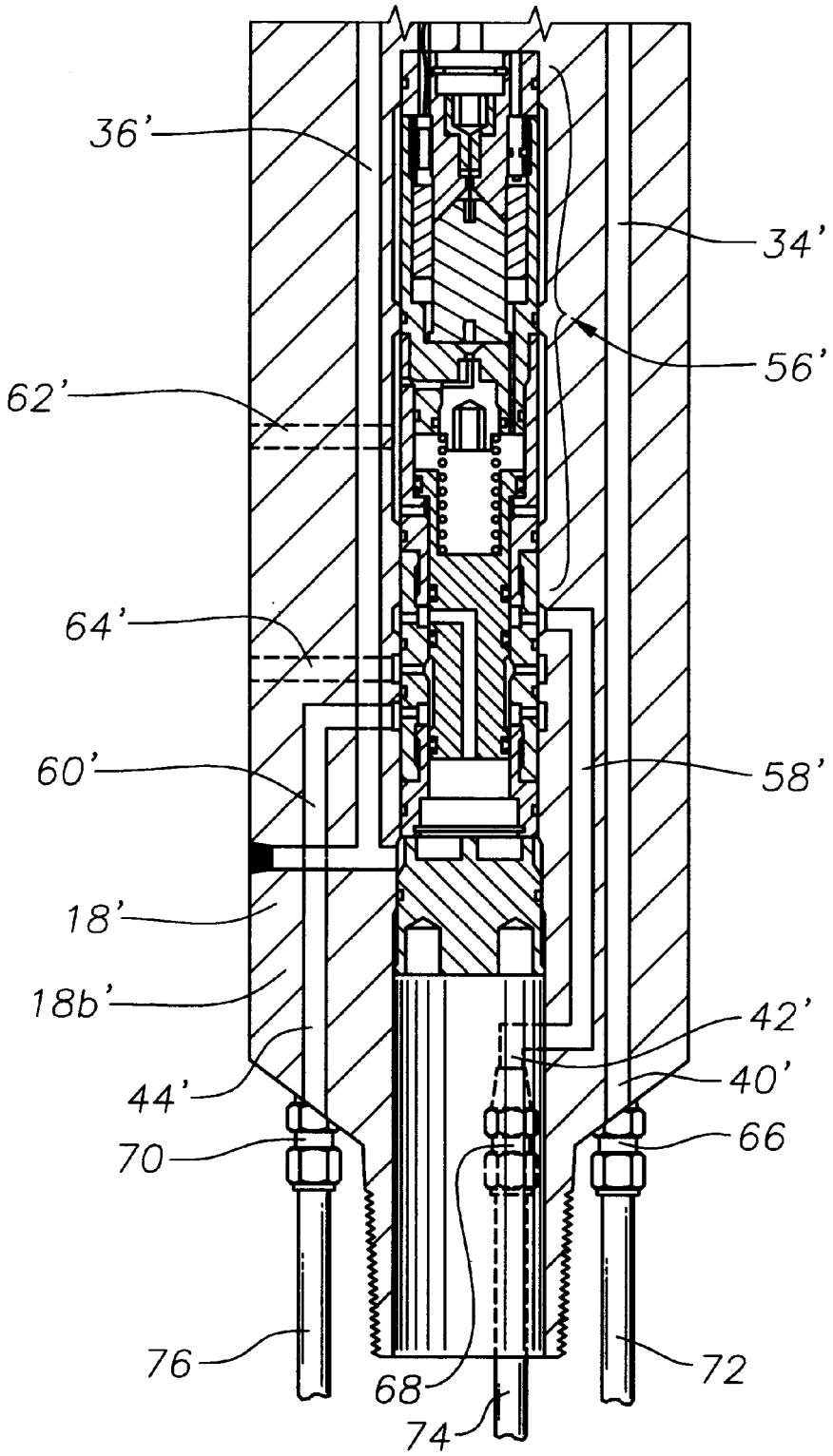

Referring to FIG. 2B, electric power flows through the electrical conductor 17*a'* to energize a solenoid 19' (FIG. 2C) that operates a downhole hydraulic pump 20'. The pump 20', which is driven by a motor 25', draws pressurized hydraulic fluid from a reservoir 22', shown in FIGS. 2D–2F, located inside the housing 18' of the actuator 10'. As shown in FIG. 2F, an axially movable volume compensator piston 30' is provided to displace the volume of fluid that is utilized as the actuator 10' of the present invention operates and to compensate for pressure changes caused by temperature fluctuations. As shown in FIG. 2D, a capacitor 21' may be provided as part of the hydraulic system to store electrical energy for later use, in a manner known to those of skill in the art. The pressurized hydraulic fluid is pumped from the reservoir 22' through a hydraulic fluid flowpath 23' (see FIGS. 2C through 2I) to the second end 18*b'* of the housing 18'. With reference to FIG. 2I, the hydraulic fluid flowpath 23' is in fluid communication with a first lower flowpath 34' and a second lower flowpath 36'. The first lower flowpath 34' is in fluid communication with a first discharge port 40' that exits from the bottom of the housing 18'. The discharge port 40' is provided with a fitting 66 for connecting to a conduits 72 through which pressurized fluid is transferred to a fluid-actuated device, such as a packer (see FIG. 5).

A permanently-set solenoid valve 54' (FIG. 2I) is electrically connected by the electrical conductor 17*b'* to the communication link 14' and mounted within the housing 18' to control fluid flow through the first lower flowpath 34'. When it is desired to permanently set the packer (FIG. 5), the solenoid valve 54' is energized via the communication link 14' thereby opening the first lower flowpath 34' and discharging pressurized hydraulic fluid through the first discharge port 40' and conduit 72.

The second lower flowpath 36' is in fluid communication with a set-unset solenoid valve 56'. The set-unset solenoid valve 56' is in fluid communication with a third lower flowpath 58', a fourth lower flowpath 60', a first vent port 62' and a second vent port 64'. The third lower flowpath 58' is in fluid communication with a second discharge port 42' that exits from the bottom of the housing 18'. Further, the discharge port 42' is provided with a fitting 68 for connecting to a conduit 74 through which pressurized fluid is transferred to the packer (see FIG. 5). The fourth lower flowpath 60' is in fluid communication with a third discharge port 44' that also exits from the bottom of the housing 18'. Further, the discharge port 44' is provided with a fitting 70 for connecting to a conduit 76 through which pressurized fluid is transferred to the packer (see FIG. 5). The set-unset solenoid valve 56' controls the flow of pressurized hydraulic fluid from the second lower flowpath 36' to the second discharge port 42' and to the third discharge port 44'. The second end 18*b'* of the housing 18' is adapted to be permanently threadably mounted to a fluid-actuated well tool (not shown), such as a packer (FIG. 5), so that the first, second, and third discharge ports 40', 42', and 44' are in fluid communication with corresponding passageways in the fluid-actuated well tool (not shown), such as the passageways 84', 92', and 94' in the novel packer 82' illustrated in FIG. 5, which will be more fully described below.

The set-unset solenoid valve 56' may be of the type illustrated in FIGS. 6A and 6B of U.S. Pat. No. 5,314,032 (Pringle et al.), which is commonly assigned hereto and incorporated herein by reference. The valve 56' may be: a shuttle-type solenoid valve; a single-acting solenoid valve with a spring return; or a double-acting solenoid valve with opposing energizable coils. The design and operation of these types of valves are well known to those of skill in the art. In a preferred embodiment, when it is desired to set the fluid-actuated tool, such as a packer (FIG. 5), the set-unset valve 56' will simultaneously disperse pressurized hydraulic fluid through the third discharge port 44' and vent any hydaulic fluid from the packer into the second discharge port 42' through one of the vent ports 62' or 64' from where it should be piped via a conduit (not shown) back to the reservoir 22' between the pump 20' and the volume compensating piston 30' so that the fluid may be reused. Similarly, when it is desired to unset the packer, the set-unset valve 56' will simultaneously disperse pressurized hydraulic fluid through the second discharge port 42' and vent hydraulic fluid from the packer into the third discharge port 44' through one of the vent ports 62' or 64', and back to the reservoir 22'.

Hydraulic Fluid Provided From External Source

Figure 3A:
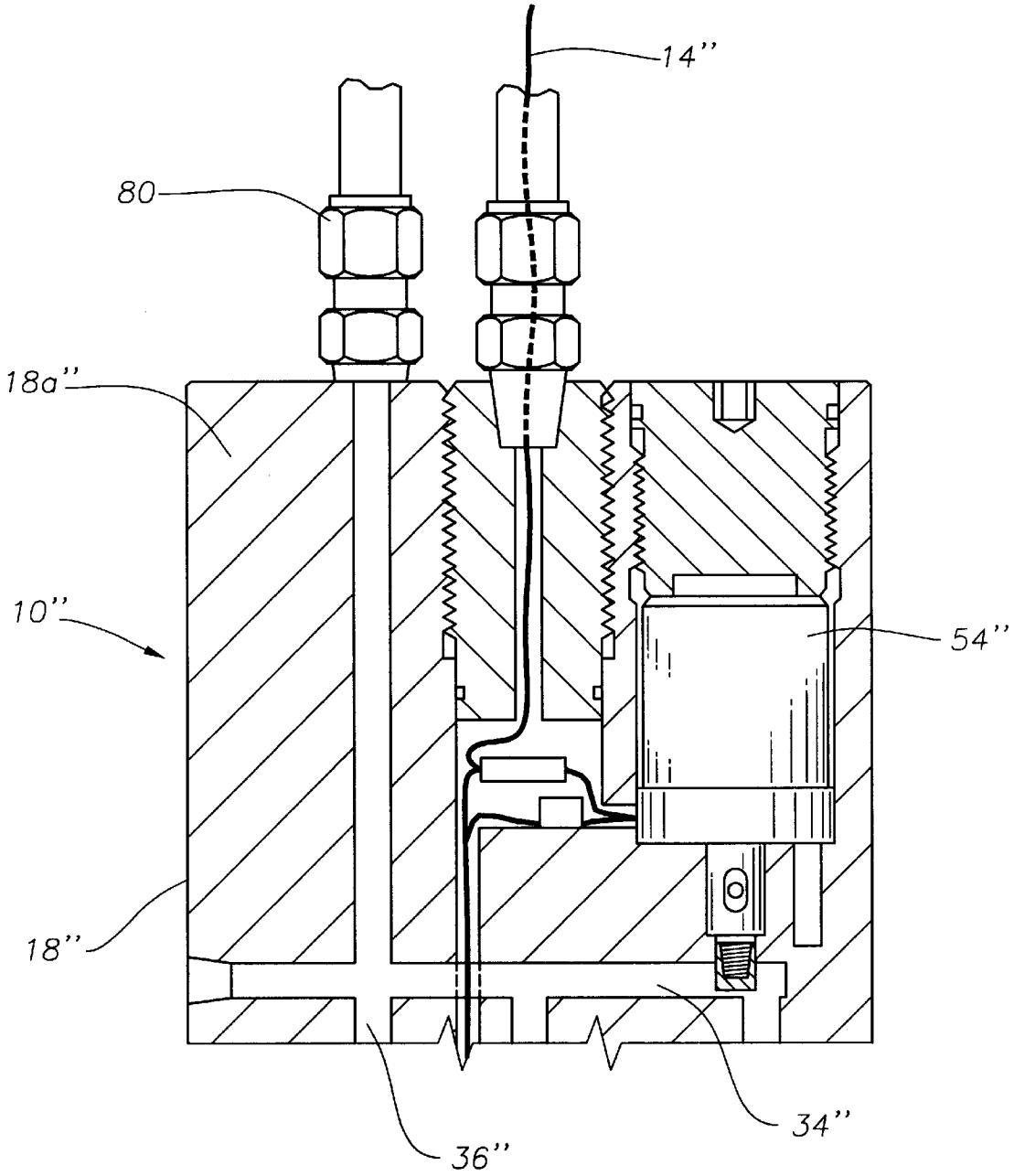
FIGS. 3A through 3C illustrate a longitudinal view shown in section and elevation of a permanently-downhole-mountable electro-hydraulic well tool actuator of the present invention, receiving pressurized hydraulic fluid from an external source, and having three hydraulic fluid discharge ports.
Figure 3B:
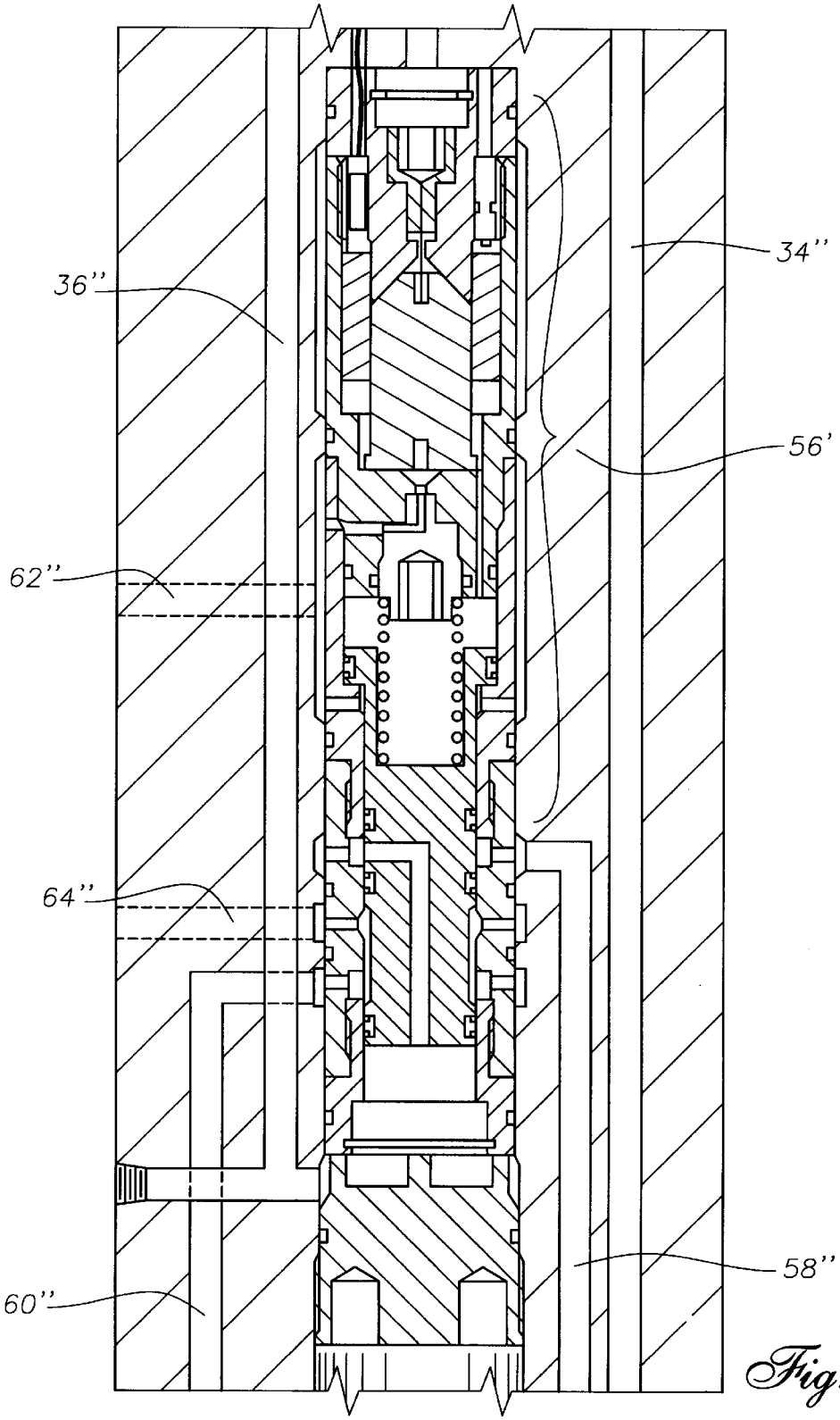
Figure 3C:
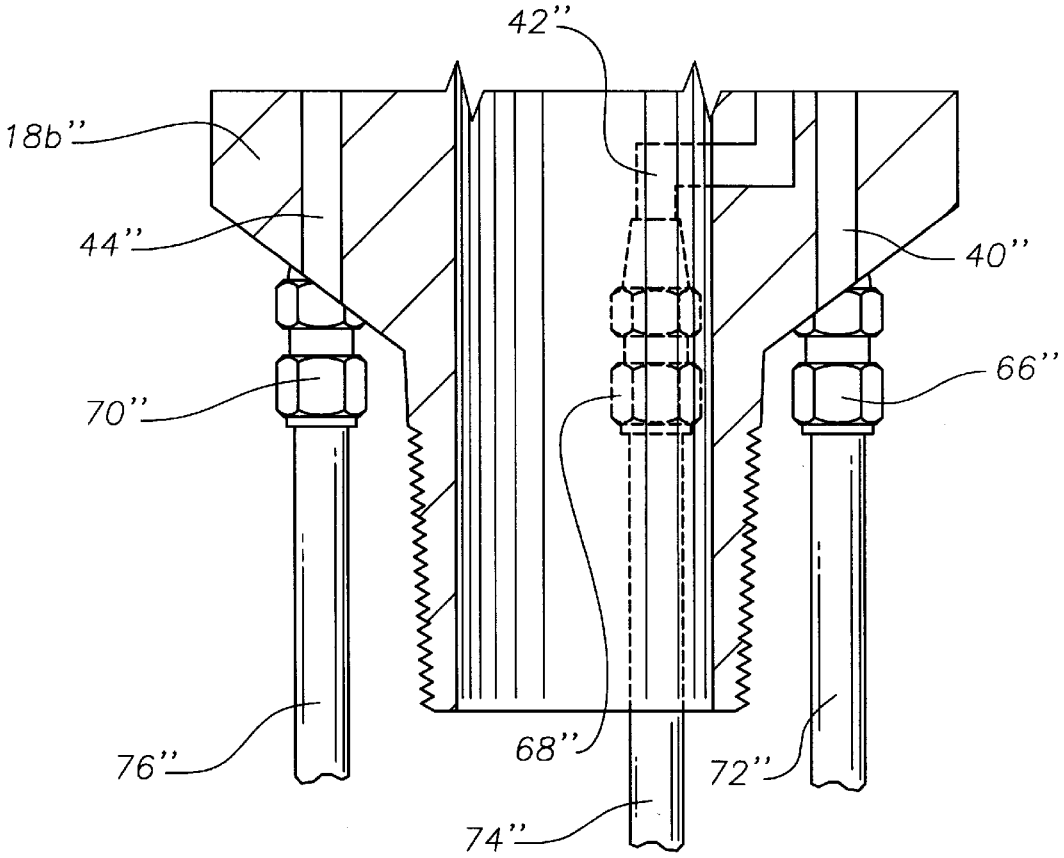

Referring now to FIGS. 3A through 3C, an alernate permanently-mounted embodiment 10" of the present invention is presented. While this configuration may be permanently mounted in any number of positions in the wellbore to operate the intended device, this illustration is for an embodiment mounted in a packer, threadably and sealably fixed thereupon.

The structure and operation of the well tool actuator 10" are similar to that of the wireline- or coiled-tubing-deployed actuator 10 and to the other permanently-mounted embodiment 10', both discussed above. However, there are differences. The key difference is that the actuator 10" of the present embodiment is not provided with its own on-board hydraulic pump system. Instead, the actuator 10" receives its pressurized hydraulic fluid from an external source, such as from the earth's surface or from another downhole well tool. The externally-provided hydraulic fluid is transferred to the actuator 10" through a hydraulic supply port 80. Further, the actuator 10" is different from the actuator 10', in that, since there is no on-board hydraulic system with the actuator 10", to which the vented fluid may be recirculated, the used fluid from the fluid-actuated well tool is vented to the annulus through the vent ports 62" and 64" (FIG. 3B).

More particularly, the actuator 10" includes a cylindrical housing 18" having a first end 18*a"* (FIG. 3A) and a second end 18*b"* (FIG. 3C). A communication link 14" is sealably connected between a control panel at the earth's surface (not shown) and the first end 18*a"* of the cylindrical housing 18". In a specific embodiment, the communication link 14' may be one or more electrical conductors which are connected to teh solenoids 54" and 56". Hydraulic fluid is supplied to the actuator 10" through the supply port 80, which is in fluid communication with a first lower flowpath 34" and a second lower flowpath 36". The first lower flowpath 34" is in fluid communication with a first discharge port 40" that exits from the bottom of the housing 18". The discharge port 40" is provided with a fitting 66" for connecting to a conduit 72" through which pressurized fluid is transferred to a fluid-actuated device, such as a packer (see FIG. 5).

A permanently-set solenoid valve 54" (FIG. 3A) is electrically connected to the communication link 14" and mounted within the housing 18" to control fluid flow through the first lower flowpath 34". When it is desired to permanently set the packer (FIG. 5), the solenoid valve 54" is energized via the communication link 14" thereby opening the first lower flowpath 34" and discharging pressurized hydraulic fluid through the first discharge port 40" and conduit 72".

The second lower flowpath 36" is in fluid communication with a set-unset solenoid valve 56". The set-unset solenoid valve 56" is in fluid communication with a third lower flowpath 58", a fourth lower flowpath 60", a first vent port 62" and a second vent port 64". The third lower flowpath 58" is in fluid communication with a second discharge port 42" that exits from the bottom of the housing 18". Further, the discharge port 42" is provided with a fitting 68" for connecting to a conduit 74" through which pressurized fluid is transferred to the packer (see FIG. 5). The fourth lower flowpath 60" is in fluid communication with a third discharge port 44" that also exits from the bottom of the housing 18". Further, the discharge port 44" is provided with a fitting 70" for connecting to a conduit 76" through which pressurized fluid is transferred to the packer (see FIG. 5). The set-unset solenoid valve 56" controls the flow of pressurized hydraulic fluid from the second lower flowpath 36" to the second discharge port 42" and to the third discharge port 44". The second end 18*b"* of the housing 18" is adapted to be permanently threadably mounted to a fluid-actuated well tool (not shown), such as a packer (FIG. 5), so that the first, second, and third discharge ports 40", 42", and 44" are in fluid communication with corresponding passageways in the fluid-actuated well tool (not shown), such as the passageways 84', 92', and 94' in the novel packer 82' illustrated in FIG. 5, which will be more fully described below.

The set-unset solenoid valve 56" may be of the type illustrated in FIGS. 6A and 6B of U.S. Pat. No. 5,314,032 (Pringle et al.), which is commonly assigned hereto and incorporated herein by reference. The valve 56" may be: a shuttle-type solenoid valve; a single-acting solenoid valve with a spring return; or a double-acting solenoid valve with opposing energizable coils. The design and operation of these types of valves are well known to those of skill in the art. In a preferred embodiment, when it is desired to set the fluid-actuated tool, such as a packer (FIG. 5), the set-unset valve 56" will simultaneously disperse pressurized hydraulic fluid through the third discharge port 44" and vent any hydraulic fluid from the packer into the second discharge port 42" through one of the vent ports 62" or 64" and into the annulus (not shown). Similarly, when it is desired to unset the packer, the set-unset valve 56" will simultaneously disperse pressurized hydraulic fluid through the second discharge port 42" and vent hydraulic fluid from the packer into the third discharge port 44" through one of the vent ports 62" or 64", and into the annulus (not shown).

Novel Packers

Figure 4:
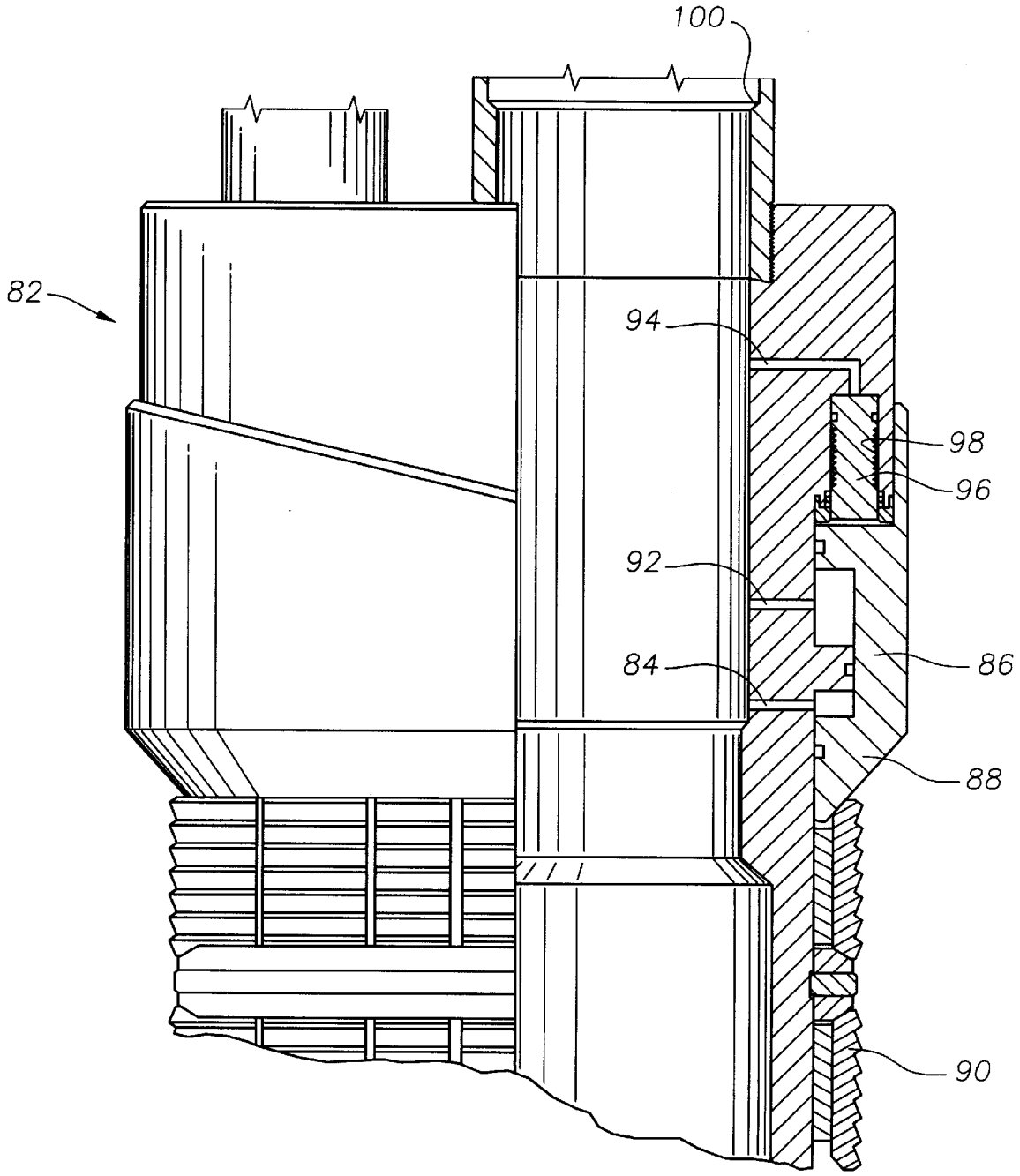
FIG. 4 illustrates a cross-section of a packer adapted to accept a coiled-tubing or wireline deployed electro-hydraulic well tool actuator of the present invention.

Referring now to FIG. 4, a novel packer 82 is disclosed which is adapted to receive and communicate with the coiled-tubing-deployed actuator 10 of the present invention, which is illustrated in FIGS. 1A through 1J. The presence of three discriminate hydraulic fluid sources allows the packer to be repeatedly set and unset at the operator's discretion until such time as a satisfactory permanent location is attained. With reference to FIGS. 1I, 1J, and 4, it can be seen that the third discharge port 44 on the actuator 10 may be sealably located adjacent a lowermost passageway 84 in the packer 82, and pressurized fluid may be directed thereto. The fluid directed to the lowermost passageway 84 enables movement of a double acting piston 86, which drives a wedge 88 under a set of slips 90 thereby setting the packer 82.

The second discharge port 42 on the actuator 10 may be sealably located adjacent a central passageway 92 in the packer 82, and pressurized fluid may be directed thereto. The fluid directed to the central passageway 92 enables the reverse movement of the double acting piston 86, which removes the wedge 88 from under the slips 90 thereby unsetting the packer 82. As explained above, the vented fluid is fed back to one of the vent ports 62 or 64 (see FIG. 1I).

When a position is found that is operationally desirable for permanently locating the packer 82, the first discharge port 40 on the actuator 10 is held adjacent an uppermost passageway 94 in the packer 82, and pressurized fluid may be directed thereto. The fluid enables movement of a ratcheted piston 96 axially downward, coating with the double acting piston 86, which drives the wedge 88 under the slips 90 thereby permanently setting the packer 82. Ratchets 98 co-acting with the ratcheted piston 96, as is well known in the art, hold the packer 82 in the permanently set position.

The packer 82 is provided with a no-go shoulder 100 for cooperating with the no-go shoulder 31 (see FIG. 1G) on the actuator 10 to align the first, second, and third discharge ports 40, 42, and 44 in the actuator 10 with the lowermost, central, and uppermost passageways 84, 92, and 94 in the packer 82.

Figure 5:
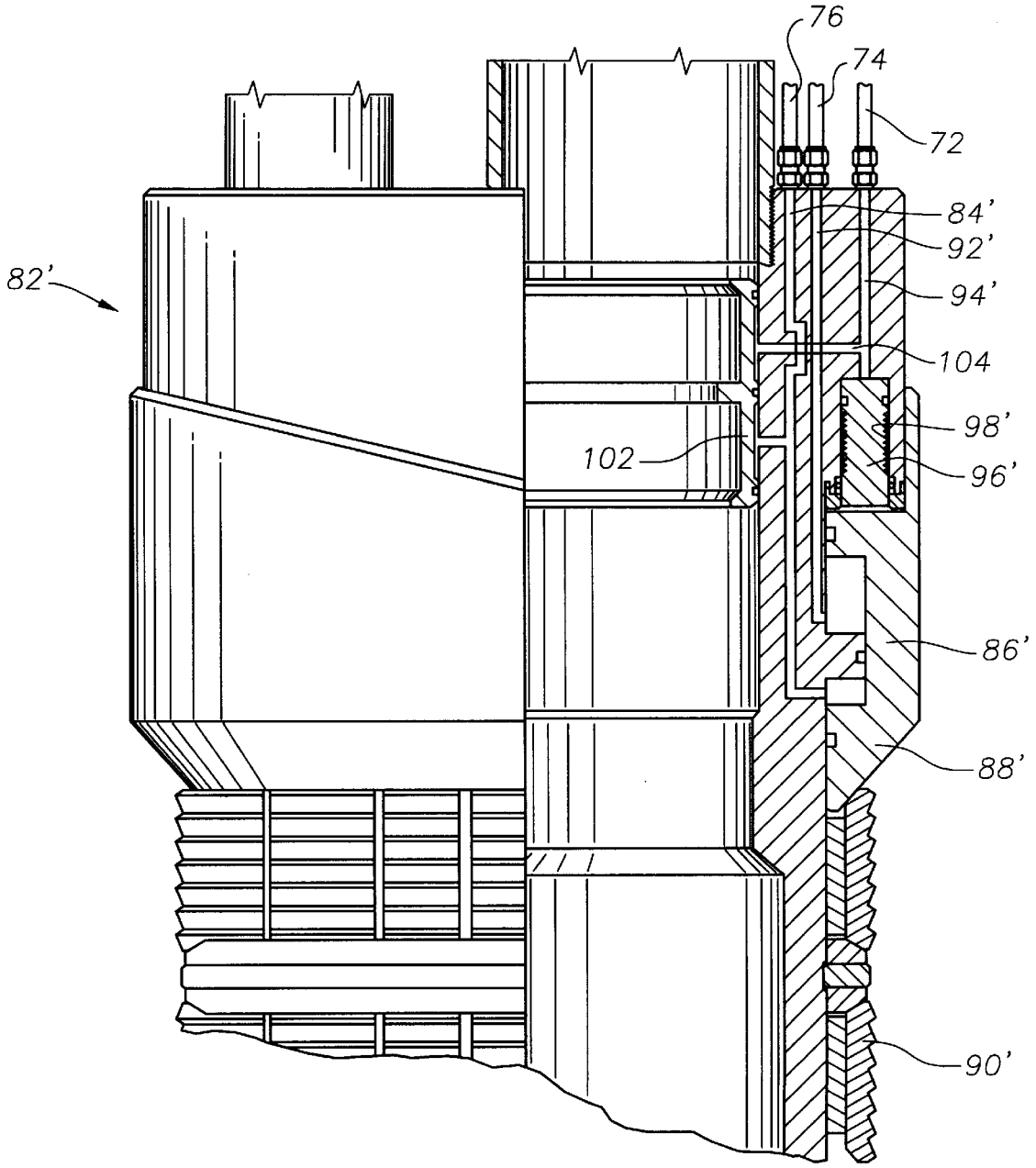
FIG. 5 illustrates a cross-section of a packer adapted to accept pressurized hydraulic fluid from a permanently-mountable electro-hydraulic well tool adapter of the present invention.

Referring now to FIG. 5, a novel packer 82' is disclosed which is adapted to receive and communicate with the permanently-mounted actuators 10' and/or 10" of the present invention. The presence of three discriminate hydraulic fluid sources allows the packer 82' to be repeatedly set and unset at the operators discretion until such time as a satisfactory permanent location is attained.

Referring to FIGS. 2I and 5, the discharge ports 40', 42', and 44' are connected by conduits 72, 74, and 76 to the lowermost, central, and uppermost passageways 84', 92', and 94', respectively, in the packer 82'. The manner in which pressurized fluid is transferred from the discharge ports 40', 42', and 44' to the passageways 84', 92', and 94' in the packer 82' is the same as explained above with regard to the packer 82. More particularly, with reference to FIGS. 2I and 5, it can be seen that the third discharge port 44' on the actuator 10' may be sealably located adjacent a lowermost passageway 84' in the packer 82', and pressurized fluid may be directed thereto. The fluid directed to the lowermost passageway 84' enables movement of a double acting piston 86', which drives a wedge 88' under a set of slips 90' thereby setting the packer 82'.

The second discharge port 42' on the actuator 10' may be sealably located adjacent a central passageway 92' in the packer 82', and pressurized fluid may be directed thereto. The fluid directed to the central passageway 92' enables the reverse movement of the double acting piston 86', which removes the wedge 88' from under the slips 90' thereby unsetting the packer 82'. As explained above, the vented fluid is fed back to one of the vent ports 62' or 64' (see FIG. 2I).

When a position is found that is operationally desirable for permanently locating the packer 82', the first discharge port 40' on the actuator 10' is held adjacent an uppermost passageway 94' in the packer 82', and pressurized fluid may be directed thereto. The fluid enables movement of a ratcheted piston 96' axially downward, coacting with the double acting piston 84', which drives the wedge 88' under the slips 90' thereby permanently setting the packer 82'. Ratchets 98' co-acting with the ratcheted piston 96', as is well known in the art, hold the packer 82' in the permanently set position.

An alternate provision to permanently set the packer 82' is provided as well. An internal shifting sleeve 102 on the packer mandrel sealably covers a communication port 104, which prevents internal pressure in the packer from activating the ratcheting piston 96' to permanently set the packer 82'. Wireline intervention, which is well known to those skilled in the art, may be employed to shift the sleeve 102, thereby exposing the communication port 104 to internal pressure to cause movement of the ratcheted piston 96' axially downward, coating with the double acting piston 86', which drives the wedge 88' under the slips 90' thereby permanently setting the packer 82'.

Whereas the present invention has been described in particular relation to the drawings attached hereto, it should be understood that other and further modifications, apart from those shown or suggested herein, may be made within the scope and spirit of the present invention. Accordingly, the invention is therefore to be limited only by the scope of the appended claims.

We claim:

1. An electro-hydraulic well tool actuator, comprising:

a cylindrical housing having a first end and a second end;

a communication link sealably connecting a control panel at the earth's surface to the first end of the housing;

at least one hydraulic fluid flowpath within said housing;

a source of pressurized hydraulic fluid to be communicated to the at least one hydraulic fluid flowpath;

at least one discharge port in fluid communication with the at least one hydraulic fluid flowpath and exiting the housing for delivering pressurized hydraulic fluid to a fluid-actuated device; and at least one solenoid valve mounted in the housing for directing the pressurized hydraulic fluid from the at least one hydraulic fluid flowpath through the at least one discharge port to the fluid-actuated device.

2. The electro-hydraulic well tool actuator of claim 1 further including a multiplexer mounted within the housing, wherein the communication link is a single electrical conductor, the electrical conductor being connected to the multiplexer.

3. The electro-hydraulic well tool actuator of claim 2 wherein the multiplexer is connected by at least one secondary electrical connector to the at least one solenoid valve.

4. The electro-hydraulic well tool actuator of claim 1 wherein the communication link is at least one electrical connector being connected to the at least one solenoid valve.

5. The electro-hydraulic well tool actuator of claim 1 further including an electric battery mounted within the housing, wherein the communication link is an acoustic conductor that communicates with the battery.

6. The electro-hydraulic well tool actuator of claim 1, wherein the source of pressurized hydraulic fluid is a hydraulic system mounted within the housing and connected to the communication link.

7. The electro-hydraulic well tool actuator of claim 6, wherein the hydraulic system includes an integral hydraulic pump, motor, and reservoir mounted within the housing, the hydraulic system being in fluid communication with the at least one hydraulic fluid flowpath.

8. The electro-hydraulic well tool actuator of claim 7, wherein the hydraulic system further includes a solenoid valve, connected to the communication link, for directing the flow of pressurized hydraulic fluid from the hydraulic system through the hydraulic fluid flowpath.

9. The electro-hydraulic well tool actuator of claim 6, wherein the hydraulic system further includes a capacitor for storing electrical energy.

10. The electro-hydraulic well tool actuator of claim 6, wherein the hydraulic system further includes a movable volume compensator piston for displacing a volume of fluid that is utilized as the actuator operates.

11. The electro-hydraulic well tool actuator of claim 1, wherein the source of pressurized hydraulic fluid is located at the earth's surface, the source being sealably connected to the first end of the housing by a hydraulic control line.

12. The electro-hydraulic well tool actuator of claim 1, wherein the source of pressurized hydraulic fluid is another downhole well tool, the source being sealably connected to the first end of the housing by a hydraulic control line.

13. The electro-hydraulic well tool actuator of claim 1, wherein the at least one solenoid valve is connected to a source of electrical energy on another downhole well tool.

14. The electro-hydraulic well tool actuator of claim 13, wherein the downhole well tool is an electric submersible pump.

15. The electro-hydraulic well tool actuator of claim 1, wherein the actuator is adapted to be deployed and retrieved by utilization of coiled tubing.

16. The electro-hydraulic well tool actuator of claim 1, wherein the actuator is adapted to be deployed and retrieved by utilization of wireline.

17. The electro-hydraulic well tool actuator of claim 1, wherein the actuator is adapted to be permanently mounted in a subterranean well.

18. The electro-hydraulic well tool actuator of claim 1, further including:

a first lower flowpath, a second lower flowpath, a third lower flowpath, a fourth lower flowpath, a first discharge port, a second discharge port, a third discharge port, a permanently-set solenoid valve, a set-unset solenoid valve, wherein the at least one hydraulic flowpath is in fluid communication with the first lower flowpath and the second lower flowpath, the first and second lower flowpaths are located adjacent the second end of the cylindrical housing, the first lower flowpath is in fluid communication with a first discharge port, the permanently-set solenoid valve is connected to the communication link and located adjacent the first lower flowpath to control fluid flow therethrough to permanently actuate the fluid-actuated device, the second lower flowpath is in fluid communication with the set-unset solenoid valve, the set-unset solenoid valve is in fluid communication with the third and fourth lower flowpaths, the third lower flowpath is in fluid communication with the second discharge port, the fourth lower flowpath is in fluid communication with the third discharge port, and the set-unset solenoid valve is connected to the communication link to control fluid flow from the second lower flowpath to the second and third discharge ports.

19. The electro-hydraulic well tool actuator of claim 18, further including:

at least one vent port, a first annular seal, a second annular seal, a third annular seal, and a fourth annular seal;

wherein the at least one vent port is in fluid communication with the set-unset solenoid valve, the first discharge port exits the second end of the housing between the first and second annular seals, the second discharge port exits the second end of the housing between the second and third annular seals, and the third discharge port exits the second end of the housing between the third and fourth annular seals.

20. The electro-hydraulic well tool actuator of claim 18, wherein the set-unset solenoid valve actuates the fluid-actuated device by simultaneously dispersing pressurized hydraulic fluid through the third discharge port and venting any hydraulic fluid from the fluid-actuated device into the second discharge port through the at least one vent port, and deactuates the fluid-actuated device by simultaneously dispersing pressurized hydraulic fluid through the second discharge port and venting any hydraulic fluid from the fluid-actuated device into the third discharge port through the at least one vent port.

21. The electro-hydraulic well tool actuator of claim 20, wherein the vented fluid is transferred from the at least one vent ports into a well annulus.

22. The electro-hydraulic well tool actuator of claim 18, wherein the set-unset solenoid valve is a shuttle-type solenoid valve.

23. The electro-hydraulic well tool actuator of claim 18, wherein the set-unset solenoid valve is a single-acting solenoid valve with a spring return.

24. The electro-hydraulic well tool actuator of claim 18, wherein the set-unset solenoid valve is a double-acting solenoid valve with opposing energizable coils.

25. An electro-hydraulic well tool actuator, comprising:

a cylindrical housing having a first end and a second end;

a communcation link sealably connecting a control panel at the earth's surface to the first end of the housing;

at least one hydraulic fluid flowpath within said housing;

a hydraulic system mounted within the housing, connected to the communication link, and in fluid communication with the at least one hydraulic fluid flowpath;

at least one discharge port in fluid communication with the at least one hydraulic fluid flowpath and exiting the housing for delivering pressurized hydraulic fluid to a fluid-actuated device; and at leaset one solenoid valve mounted in the housing for directing the pressurized hydraulic fluid from the at least one hydraulic fluid flowpath to the at least one discharge port.

26. The electro-hydraulic well tool actuator of claim 25, further including a multiplexer mounted within the first end of the housing, wherein the communication link is a single electrical conductor, the electrical conductor being connected to the multiplexer.

27. The electro-hydraulic well tool actuator of claim 26, wherein the multiplexer is connected by at least one secondary electrical connector to the at least one solenoid valve.

28. The electro-hydraulic well tool actuator of claim 26, wherein the communication link is at least one electrical connector being connected to the at least one solenoid valve.

29. The electro-hydraulic well tool actuator of claim 26, further including an electric battery mounted within the housing, wherein the communication link is an acoustic conductor that communicates with the battery.

30. The electro-hydraulic well tool actuator of claim 26, wherein the hydraulic system includes an integral hydraulic pump, motor, and reservoir mounted within the housing, the hydraulic system being in fluid communication with the at least one hydraulic fluid flowpath.

31. The electro-hydraulic well tool actuator of claim 30, wherein the hydraulic system further includes a solenoid valve, connected to the communication link, for directing the flow of pressurized hydraulic fluid from the hydraulic system through the hydraulic fluid flowpath.

32. The electro-hydraulic well tool actuator of claim 30, wherein the hydraulic system further includes a capacitor for storing electrical energy.

33. The electro-hydraulic well tool actuator of claim 30, wherein the hydraulic system further inlcudes a movable volume compensator piston for displacing a volume of fluid that is utilized as the actuator operates.

34. The electro-hydraulic well tool actuator of claim 26, wherein the actuator is adapted to be retrievably deployed by utilization of coiled tubing.

35. The electro-hydraulic well tool actuator of claim 26, wherein the actuator is adapted to be retrievably deployed by utilization of wireline.

36. The electro-hydraulic well tool actuator of claim 26, further including:

a first lower flowpath, a second lower flowpath, a third lower flowpath, a fourth lower flowpath, a first discharge port, a second discharge port, a third discharge port, a permanently-set solenoid valve, a set-unset solenoid valve, wherein the at least one hydraulic flowpath is in fluid communication with the first lower flowpath and the second lower flowpath, the first and second lower flowpaths are located adjacent the second end of the cylindrical housing, the first lower flowpath is in fluid communication with a first discharge port, the permanently-set solenoid valve is connected to the communication link and located adjacent the first lower flowpath to control fluid flow therethrough to permanently actuate the fluid-actuated device, the second lower flowpath is in fluid communication with the set-unset solenoid valve, the set-unset solenoid valve is in fluid communication with the third and fourth lower flowpaths, the third lower flowpath is in fluid communication with the second discharge port, the fourth lower flowpath is in fluid communication with the third discharge port, and the set-unset solenoid valve is connected to teh communication link to control fluid flow from the second lower flowpath to the second and third discharge ports.

37. The electro-hydraulic well tool actuator of claim 36, further including:

at least one vent port, a first annular seal, a second annular seal, a third annular seal, and a fourth annular seal;

wherein the at least one vent port is in fluid communication with the set-unset solenoid valve, the first discharge port exits the second end of the housing between the first and second annular seals, the second discharge port exits the second end of the housing between the second and third annular seals, and the third discharge port exits the second end of the housing between the third and fourth annular seals.

38. The electro-hydraulic well tool actuator of claim 36, wherein the set-unset solenoid valve actuates the fluid-actuated device by simultaneously dispersing pressurized hydraulic fluid through the third discharge port and venting any hydraulic fluid from the fluid-actuated device into the second discharge port through the at least one vent port, and deactuates the fluid-actuated device by simultaneously dispersing pressurized hydraulic fluid through the second discharge port and venting any hydraulic fluid from the fluid-actuated device into the third discharge port through the at least one vent port.

39. The electro-hydraulic well tool actuator of claim 38, wherein the vented fluid is transferred from the at least one vent port into a well annulus.

40. The electro-hydraulic well tool actuator of claim 36, wherein the set-unset solenoid valve is a shuttle-type solenoid valve.

41. The electro-hydraulic well tool actuator of claim 36, wherein the set-unset solenoid valve is a single-acting solenoid valve with a spring return.

42. The electro-hydraulic well tool actuator of claim 36, wherein the set-unset solenoid valve is a double-acting solenoid valve with opposing energizable coils.

43. The electro-hydraulic well tool actuator of claim 36, further including a first fluid transfer conduit, a second fluid transfer conduit, and a third fluid transfer conduit, the first conduit being connected to the first discharge port, the second conduit being connected to the second discharge port, and the third conduit being connected to the third discharge port, whereby pressurized fluid may be transferred to and from the fluid-actuated device.

44. The electro-hydraulic well tool actuator of claim 43, wherein the set-unset solenoid valve will actuate the fluid-actuated device by simultaneously dispersing pressurized hydraulic fluid through the third discharge port and third conduit and venting any hydraulic fluid from the fluid-actuated device into the second discharge port through the second conduit and to the at least one vent port, and deactuates the fluid-actuated device by simultaneously dispersing pressurized hydraulic fluid through the second discharge port and second conduit and venting any hydraulic fluid from the fluid-actuated device into the third discharge port through the third conduit and to the at least one vent port.

45. The electro-hydraulic well tool actuator of claim 44, wherein the vented fluid is transferred from the at lesat one vent port into a well annulus.

46. The electro-hydraulic well tool actuator of claim 44, wherein the vented fluid is transferred from the at least one vent port to the hydraulic system to be reused.

47. The electro-hydraulic well tool actuator of claim 44, further including an auxiliary port in fluid communication with the at least one hydraulic flowpath to operate an additional well tool.

48. The electro-hydraulic well tool actuator of claim 25, wherein the actuator is adapted to be permanently mounted within a subterranean well.

49. An electro-hydraulic well tool actuator, comprising:

a cylindrical housing having a first and second end;

at least one hydraulic fluid flowpath within said housing;

a communication link sealably connected to said housing on said first end and a control panel located at the earth's surface;

at least one solenoid valve mounted in said housing for directing the flow of hydraulic fluid through said at least one flowpath;

at least one discharge port in said housing for delivering pressurized hydraulic fluid; and, annular seals isolating said at least one discharge port and directing said pressurized fluid to a fluid-actuated device.

50. The electro-hydraulic well tool actuator of claim 49, further including a hydraulic system contained by and mounted within the housing.

51. The electro-hydraulic well tool actuator of claim 50, wherein the hydraulic system further comprises an integral hydraulic pump, motor, and a reservoir mounted within said housing.

52. The electro-hydraulic well tool actuator of claim 50, wherein the communication link further comprises a single electrical conductor connecting the control panel and a multiplexer mounted within said housing.

53. The electro-hydraulic well tool actuator of claim 50, wherein the communication link further comprises an acoustic conductor connecting the control panel communicating with an electric battery mounted within the housing.

54. The electro-hydraulic well tool actuator of claim 49, wherein the actuator is adapted to be deployed and retrieved by utilization of coiled tubing.

55. The electro-hydraulic well tool actuator of claim 49, wherein the actuator is adapted to be deployed and retrieved by utilization of wireline.

56. The electro-hydraulic well tool actuator of claim 49, wherein the actuator is adapted to be permanently mounted in a subterranean well.

57. An electro-hydraulic well tool actuator comprising:

a cylindrical housing having a first and second end;

at least one hydraulic fluid flowpath within said housing;

a communication link sealably connected to said housing on said first end and a control panel located at the earth's surface;

at least one solenoid valve mounted in said housing for directing the flow of hydraulic fluid through said at least one flowpath;

at least one discharge port in said housing for delivering pressurized hydraulic fluid; and, control conduit sealably connected to said at least one discharge port and directing said pressurized fluid to a fluid-actuated device.

58. The electro-hydraulic well tool actuator of claim 57, wherein said actuator further comprises a hydraulic system contained by and mounted within said housing.

59. The electro-hydraulic well tool actuator of claim 58, wherein said hydraulic system further comprises an integral hydraulic pump, motor, and a reservoir mounted within said housing.

60. The electro-hydraulic well tool actuator of claim 58, wherein said communication link further comprises a single electrical conductor connecting said control panel and a multiplexer mounted within said housing.

61. The electro-hydraulic well tool actuator of claim 58, wherein said communication link further comprises an acoustic conductor connecting said control panel communicating with an electric battery mounted within said housing.

62. The electro-hydraulic well tool actuator of claim 57, wherein said actuator is adapted to be deployed and retrieved by utilization of coiled tubing.

63. The electro-hydraulic well tool actuator of claim 57, wherein said actuator is adapted to be deployed and retrieved by utilization of wireline.

64. The electro-hydraulic well tool actuator of claim 57, wherein said actuator is adapted to be permanently mounted in a subterranean well.

* * * * *